US007596834B2

(12) United States Patent
Shinkado

(10) Patent No.: US 7,596,834 B2
(45) Date of Patent: Oct. 6, 2009

(54) FIBER OPENING APPARATUS FOR MASS FIBERS

(75) Inventor: Hiroaki Shinkado, Fukui (JP)

(73) Assignee: Harmon Industry Co., Ltd., Fukui (JP)

( * ) Notice: Subject to any disclaimer, the term of this patent is extended or adjusted under 35 U.S.C. 154(b) by 830 days.

(21) Appl. No.: 10/523,978

(22) PCT Filed: Aug. 1, 2003

(86) PCT No.: PCT/JP03/09858

§ 371 (c)(1),
(2), (4) Date: Aug. 16, 2005

(87) PCT Pub. No.: WO2004/015184

PCT Pub. Date: Feb. 19, 2004

(65) Prior Publication Data

US 2006/0117538 A1 Jun. 8, 2006

(30) Foreign Application Priority Data

Aug. 8, 2002 (JP) ..... 2002-231772

(51) Int. Cl.
*D01G 15/02* (2006.01)

(52) U.S. Cl. ..... 19/66 R; 19/98

(58) Field of Classification Search ..... 19/66 R, 19/98; 28/271, 274, 283
See application file for complete search history.

(56) References Cited

U.S. PATENT DOCUMENTS

| | | | | |
|---|---|---|---|---|
| 6,032,342 | A * | 3/2000 | Kawabe et al. | 28/283 |
| 6,684,468 | B1 * | 2/2004 | Lujan | 28/103 |
| 2006/0137156 | A1 * | 6/2006 | Kawabe et al. | 28/271 |

FOREIGN PATENT DOCUMENTS

| | | | |
|---|---|---|---|
| EP | 0837162 | A | 4/1998 |
| JP | 50-121568 | A | 9/1975 |
| JP | 5-247716 | A | 9/1993 |
| JP | 11-1722562 | A | 6/1999 |
| JP | 11-200136 | A | 7/1999 |
| JP | 09-538743 | | 5/2000 |

* cited by examiner

*Primary Examiner*—Shaun R Hurley
(74) *Attorney, Agent, or Firm*—Arent Fox LLP

(57) ABSTRACT

A carding machine for bundled fibers includes a feed roll wound with the bundled fibers; a carding unit to card the bundled fibers drawn out from the feed roll with a fluid that flows in a direction that is orthogonal relative to a moving direction of the bundled fibers; and a rewind roll that rewinds a carded sheet formed by the bundled fibers that are carded in the carding unit, wherein the carding unit includes an internal frame that forms a fluid flow path and a plurality of supporting parts placed along the moving direction of the bundled fibers between a front end and a back end in the moving direction of the bundled fibers within the frame.

33 Claims, 18 Drawing Sheets

25a'
25b'
25c'
25'
254'
259b
259a
254a
252'
256a
253'
W1
W2
W3
t1
t2
t3

250'
253'
251'
259b
259a
254a
260

251a
251'

Fig. 19 (A) (Prior Art)
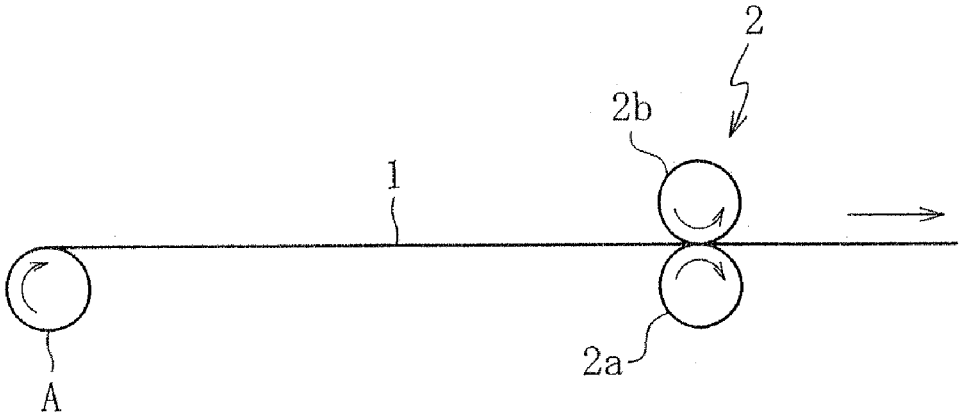
Fig. 19 (B) (Prior Art)
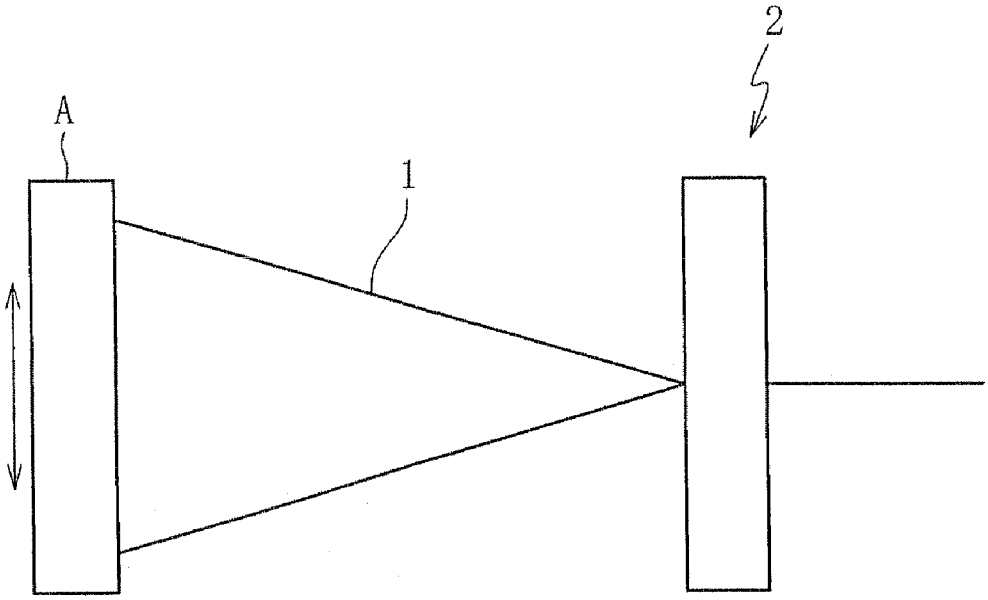

FIBER OPENING APPARATUS FOR MASS FIBERS

TECHNICAL FIELD

The invention relates to a machine that cards bundled fibers, wherein the bundled fibers travel through a carding unit into which fluid flows orthogonally relative to the moving direction of the bundled fibers and wherein a moving force is applied to the bundled fibers, a widthwise direction of the bundled fibers being extended so the bundled fibers can be carded into a sheet.

BACKGROUND ART

In recent years, many fiber-reinforced composite materials have been developed in which a reinforcing material, such as carbon fibers, glass fibers, or aromatic polyamide fibers are impregnated in filament or fabric form into a matrix, like a synthetic resin.

By correctly selecting the matrix and reinforcing material, the known fiber-reinforced materials have a wide-range of excellent properties that can be utilized based on the desired objective of use with respect to mechanical strength, heat resistance, corrosion resistance, electric properties, and weight reduction. The known fiber-reinforced materials are widely used in such technical fields as aerospace, land transportation, shipping, building, construction, industrial parts, and sporting goods.

There are two common uses of the reinforcing fibers. One common use is where the material is impregnated with the reinforcing filaments to form a matrix; while the other use is by parallel alignment of many filaments wide enough to cover the width of the matrix. In the latter use, it is desirable to make the contact area between the matrix and reinforcing filaments as large as possible. Therefore, many reinforcing filaments that are treated with an adhesive (sizing agent) are bundled while having either a flat or ellipsoidal cross-section to form the bundled fibers, in which each reinforcing filament is aligned so as to minimize the space between them, wherein a thin but wide carded sheet is obtained. Impregnation of the carded sheet in the matrix promotes the matrix being impregnated into small spaces, wherein the contact area between the matrix and the reinforcing filament is maximized, and the reinforcing filaments help maximize the reinforcing effects of the fibers.

Accordingly, an airflow carding machine for bundled fibers is disclosed in Japanese Patent Publication No. 3,064,019, wherein a so called suction wind tunnel pipe with a predetermined width is positioned to face a moving path of bundled fibers provided by a supply unit (feed roll) to a take-up section (rewind roll), and wherein the bundled fibers (for example, multifilament) are continuously suctioned in a certain overfed condition to bend the bundled fibers into a crescent shape so the fibers can be carded in the widthwise direction.

The airflow carding machine for the bundled fibers disclosed in Japanese Patent Publication No. 3,064,019 can effectively card the bundled fibers of very long multifilaments in parallel without causing damage.

As shown in FIG. 17, the bundled fibers 1 are drawn from a feed roll A, and then travel through a front feeder 2, which includes a drive roll 2*a* and a free revolving roll 2*b*, into which an airflow carding unit 3 cards the fibers 1 to yield a carded sheet 1*a*. The carded sheet 1*a* is fed through a back feeder 4 to rewind the sheet 1*a* around a rewind roll B, wherein the degree of bending of the bundled fiber 1 traveling through a suction wind tunnel 3*a* of the airflow carding unit 3 is detected by a fiber height detection unit 5.

The fiber height detection unit 5 controls the level of bending of the bundled fibers 1 by pressing down on all of the bundled fibers 1 with a wire-like fiber height sensor unit 5*a*, and then detects the location of a retaining unit 5*b* tied with the fiber height sensor unit 5*a* by a sensor 5*c*, which feeds back the detected signal to a driver motor of the driving roll 2*a*. The number of revolutions and the amount of the bundled fibers 1 drawn out by the drive roll 2*a* and free revolving roll 2*b* is adjusted according to the amount of bundled fibers being overted as well as to control the amount of bending occurring to the bundled fibers.

As shown in FIG. 18, more than one airflow carding unit $\mathbf{3}_1$, $\mathbf{3}_2$, and $\mathbf{3}_3$ is aligned to form a multistage section in the moving direction of the bundled fibers since a single airflow carding unit 3 alone cannot sufficiently card the bundled fibers. In this case, as shown in FIG. 18, feed roll units $\mathbf{2}_1$, $\mathbf{2}_2$, $\mathbf{2}_3$, and 4 are installed before and after each airflow carding unit $\mathbf{3}_1$, $\mathbf{3}_2$, and $\mathbf{3}_3$ together with the aforementioned fiber height detection units $\mathbf{5}_1$, $\mathbf{5}_2$, and $\mathbf{5}_3$ at each airflow carding unit $\mathbf{3}_1$, $\mathbf{3}_2$, and $\mathbf{3}_3$, respectively, in order to make the carding process proceed smoothly at each airflow carding unit $\mathbf{3}_1$, $\mathbf{3}_2$, and $\mathbf{3}_3$.

SUMMARY OF THE INVENTION

An aspect of the present invention is to provide a carding machine capable of continuously carding bundled fibers without having to detect the level of bending of the bundled fibers in the carding unit by using the fiber height detection unit that feedbacks a detected signal to the driver motor of the front feeder drive roll to control the depth of bending as is done in the aforementioned conventional airflow carding machine.

Another aspect of the present invention is to provide a compact, lightweight, and economical carding machine, wherein uniform and highly carded filaments are constantly produced by using one or more supportive parts with a small diameter in the carding unit.

An additional aspect of the present invention is to simplify the support structure of the feed roll such that the required space for installation is reduced and a carding machine with multiple spindles or multiple spindle multistage bundled fibers is obtained.

In order to achieve the aforementioned aspects, the carding machine for bundled fibers in the present invention includes a carding unit which cards the bundled fibers fed from a feed roll wound with the bundled fibers; by flowing fluid in a direction that is orthogonal relative to the moving direction of the bundled fibers; by having a rewind roll rewinding the carded sheet in the carding unit; and by having one or more supportive parts placed in a predetermined interval along the moving direction.

According to the above-described structural configuration, the direction that the fluid flows in the carding unit can either suction the fluid flowing downward, from above to below, or flowing upward, from below to above, so long as the fluid flows in the direction that is orthogonal relative to the moving direction of the bundled fibers. Similarly, the suction fluid flow direction can be such regardless as to whether the fluid flow direction is right to left or left to right.

Increasing the number of supportive parts in the carding unit reduces the interval distance, as well as the bending of the bundled fibers, between the supportive parts, whereas increasing the diameter of the supportive parts increases the number of supportive parts to prevent bending and reducing their interval distance, leading to a decrease of bending of the bundled fibers between the supportive parts. However, increasing the number of supportive parts or the diameter thereof tends to excessively reduce the flow area of the fluid, along with the interval distance, resulting in a decrease in the carding efficiency of the fluid. Therefore, the number, diameter, and interval distance of the supportive parts needs to be properly set according to the kind of bundled fibers, the diameter and number of the filaments, and the kind of a sizing agent.

The aforementioned one or more supportive parts that are installed at a particular interval can be positioned linearly, horizontally, tilted, or in a crescent shape, according to the type of bundled fibers, the diameter and number of the reinforcing filament, and the kind of sizing agent.

According to the aforementioned structure of the carding machine for the bundled fibers, the carding unit possesses one or more supportive parts arranged orthogonal relative to the moving direction of the bundled fibers and the carding action in the conventional wind tunnel pipe performed by passing the bundled fibers and the carded sheet over one or more supportive parts aligned at small intervals is done before and after on both sides of the single supportive part, or continuously done before and after in small stepwise intervals for each of the more than one supportive parts, leading to more reliable carding action and better quality in carding.

Furthermore, the bundled fibers moving in the carding unit are constantly carded, responding to the alignment condition of one or more supportive parts. Therefore, the fiber height detection unit required by the conventional machines is omitted, which leads to a smaller, lightweight, and less costly carding machine.

In the carding machine of the present invention, the carding unit also includes a frame forming a flow path for the fluid and possesses both a large diameter guiding part placed at the front and back ends of the guiding part in the moving direction of the bundled fibers and one or more small diameter supportive parts placed between these guiding parts.

According to the aforementioned structure of the carding machine, the bundled fibers are stably fed into and stably pass out from the carding unit. Furthermore, the bundled fibers moving in the carding unit can be kept in a constant configuration that corresponds to the placement of the single or multiple supportive parts, leading to uniform carding and eliminates the requirement of detecting the fiber height in the carding unit. That is, using smaller diameter supportive part makes the fluid flow path area larger, thereby improving carding action in the carding unit.

The carding machine of the present invention also includes a guiding and/or supportive part that has a roughly cylindrical form and a fixed or revolvable form around a shaft.

According to the aforementioned structure of the carding machine, a friction force generated by the flow force of the fluid from the guiding and/or supporting parts applies a smooth carding action to the moving bundled fibers over the guiding and/or supportive parts. When the guiding and/or supportive parts are fixed, their structure becomes simple and the machine can be manufactured at low cost. When the guiding and/or supportive parts are able to revolve around the shaft, the guiding and/or supportive parts revolve around the shaft by moving bundled fibers to make movement of the bundled fibers smooth and reduce the friction between the bundled fibers and the guiding and/or supportive parts. Furthermore, the area of friction is diffused in a circumferential direction to prolong the life of the guiding and/or supportive parts.

The carding machine of the present invention further includes multiple supportive parts positioned in a plane or roughly, in a crescent, against the moving direction of the bundled fibers.

According to the aforementioned structure of the carding machine, the bundled fibers moving on the supportive parts can move and can be carded constantly, keeping a planar or crescent configuration against the moving direction according to the setup of the supportive parts, thereby making efficient carding possible. In the case that the bundled fibers are carded in the crescent configuration, an excess mass of overfed bundled fibers can be absorbed by sinking of the fibers, so that the contact area between the bundled fibers and fluid is increased, wherein the carding efficiency is improved, especially when compared to the case where multiple supportive parts are set flat.

The carding machine of the present invention also includes placing the carding unit in a multistage format along the moving direction of the bundled fibers.

According to the aforementioned structure of the carding machine, the carding unit is aligned in multiple stages along the moving direction of the bundled fibers, and carding of the bundled fibers is processed step by step, smoothly moving the bundled fibers over the multistage carding unit from an upstream end to a downstream end. In this case, the front feeder upstream of each carding unit is also not required, which simplifies, miniaturizes, lightens, and minimizes cost and shortens the total length of the carding machine.

The carding machine of the present invention may further include increasing stepwise, or continuously, the width of the moving path of the bundled fibers.

According to the aforementioned structure of the carding machine, the width of the flow path for the bundled fibers in the multistage carding unit is more orderly, stepwise or continuously, from the upstream end to the downstream end, and carding of the bundled fibers is progressed to adjust for this widening, as the bundled fibers move from the upstream end to the downstream end, to pass the carding unit in each stage, smoothly yielding a carded sheet.

The carding machine of the present invention further places the shaft of the feed roll in a vertical direction. Here, "vertical direction" includes not only a geometrically perpendicular arrangement, but also a tilted arrangement at a certain angle relative to the perpendicular.

According to the aforementioned structure of the carding machine, the supply position of the bundled fibers relative to the guide roll at the entrance of the carding action section sways less compared to the conventional machine, which arranges the shaft of the feed roll horizontally. Furthermore, the degree of swaying of the bundled fibers is absorbed along the circumference of the guide roll so that the feed roll is not required to traverse the shaft direction, the structure of the supporting action section can be simplified, and the required space for installation of the feed roll is reduced.

The carding machine of the present invention includes a plurality of feed rolls.

According to the aforementioned structure of the carding machine, more than one set of bundled fibers can be fed from each feed roll so as to be carded at the carding unit, thereby yielding a wide carded sheet. Furthermore, as each shaft of multiple feed rolls is positioned vertically, more than one feed roll can be placed close to each other to achieve a multiple spindle carding machine.

The carding machine of the present invention includes a plurality of carding units positioned in parallel and orthogonal relative to the moving direction of the bundled fibers.

According to the aforementioned structure of the carding machine, aligning a plurality of carding units in parallel, but orthogonal relative to the moving direction of the bundled fibers, more than one set of bundled fibers from the multiple feed rolls can travel over more than one carding unit to simultaneously card so as to give a multiple spindle sequential carding machine that produces a wider carded sheet.

The carding machine of the present invention consolidates the carding unit into a single carding form that shares a part of the component part, wherein the carding unit is placed in a multistage format along the moving direction of the aforementioned bundled fibers, and/or more than one carding unit is positioned in parallel but orthogonal relative to the moving direction of the bundled fibers.

According to the aforementioned structure of the carding machine, the multistage carding unit is placed in the moving direction of the bundled fibers, and/or more than one carding unit is positioned in parallel but orthogonal relative to the moving direction of the bundled fibers to consolidate into a sequentially integrated form, sharing at least a part of the component materials for the fluid flow path, spacer, and guiding part. As such, not only is a wide carded sheet obtained, but also the number of component parts is reduced to save on material costs when compared to the alignment of more than one carding unit in series or in parallel. Furthermore, the length and/or width in the sequentially integrated carding unit is reduced to achieve miniaturization, weight reduction, and cost saving of the carding machine.

The carding machine of the present invention includes a fluid path filled with a heated fluid.

According to the aforementioned structure of the carding machine, a sizing agent sticking to the bundled fibers is heated to melt in the carding unit that is heated by a fluid to weaken the bonding force between the reinforced fibers forming the bundled fibers, thereby improving the carding efficiency of the bundled fibers.

The carding machine of the present invention includes heating the guiding and/or supportive parts.

According to the aforementioned structure of the carding machine, the bundled fibers are heated by heating the guiding and/or supportive parts in the carding unit, and the sizing agent sticking to the bundled fibers is heated to melt and weaken the bonding force between the reinforced fibers forming the bundled fibers, thereby improving the carding efficiency of the bundled fibers.

The carding machine of the present invention includes providing the guiding and/or supportive parts with a built-in heater.

According to the aforementioned structure of the carding machine, the bundled fibers are heated by the guiding parts and/or supportive parts with a built-in heater, and the sizing agent sticking to the bundled fibers is heated to melt and weaken the bonding force between the reinforced fibers forming the bundled fibers, thereby improving the carding efficiency of the bundled fibers.

The carding machine of the present invention includes having the aforementioned guiding and/or supportive parts in a pipe shape, in which heated fluid is circulated.

According to the aforementioned structure of the carding machine, the bundled fibers are heated by the guiding and/or supportive parts which in turn has been heated by a heated fluid, and the sizing agent sticking to the reinforced fibers forming the bundled fibers is heated, melting and weakening the bonding force, thereby improving the carding efficiency of the bundled fibers.

The carding machine of the present invention includes a slit in the aforementioned pipe shaped guiding and/or supportive parts that crosses in the moving direction of the bundled fibers, wherein the heated fluid is ejected from the slit.

According to the aforementioned structure of the carding machine, the bundled fibers are heated by the heated fluid ejected from the slits of the pipe shaped guiding parts and/or supportive parts, and the sizing agent sticking to the bundled fibers is heated, melting and weakening the bonding force between the reinforced fibers forming the bundled fibers, drastically improving the carding efficiency of the bundled fibers via the carding action of the heated fluid.

BRIEF DESCRIPTION OF DRAWINGS

FIG. 4 (B) is a side view of the first stage airflow carding unit of the multistage airflow carding unit shown in FIG. 3;

FIG. 4 (C) is a side view of the second stage airflow carding unit of the multistage airflow carding unit shown in FIG. 3;

FIG. 4 (D) is a side view of the third stage airflow carding unit of the multistage airflow carding unit shown in FIG. 3;

FIG. 5 (B) is a schematic diagram of the components for the machine shown in FIG. 5 (A);

FIG. 6 (B) is an enlarged frontal view of the sequentially integrated airflow carding unit shown in FIG. 6 (A);

FIG. 6 (C) is an enlarged frontal view of key components shown in FIG. 6 (B);

FIG. 12 (B) is a schematic diagram of a carding machine for the multiple spindle bundled fibers shown in FIG. 12 (A);

FIG. 13 (B) is an enlarged frontal view of the feed roll shown in FIG. 13 (A);

FIG. 13 (C) is an enlarged diagram of the feed roll, in the fed state, shown in FIG. 13 (A);

FIG. 15 (B) is a vertical sectional view of the support structure of the supportive parts in the carding machine for the multiple spindle bundled fibers shown in FIG. 15 (A);

FIG. 16 (B) is an enlarged sectional view of a pipe shaped guiding and/or supportive parts equipped with a built-in heater;

FIG. 16 (C) is an enlarged sectional view wherein the guiding and/or supportive parts are pipe-shaped and circulate heated fluid through the inside of hollow pipe;

FIG. 16 (D) is an enlarged sectional view wherein the guiding and/or supportive parts have a pipe shape and slits that cross the carded sheet, and wherein heated gas is circulated inside the hollow pipe;

FIG. 19 (A) is a schematic diagram illustrating one of the problems in the conventional machine shown in FIG. 18; and FIG. 19 (B) is a schematic planar view of the feed unit shown in FIG. 19 (A).

DETAILED DESCRIPTION OF PREFERRED EMBODIMENTS OF THE INVENTION

Various embodiments according to the present invention are described below with reference to the accompanying drawings.

First Embodiment

Figure 1:
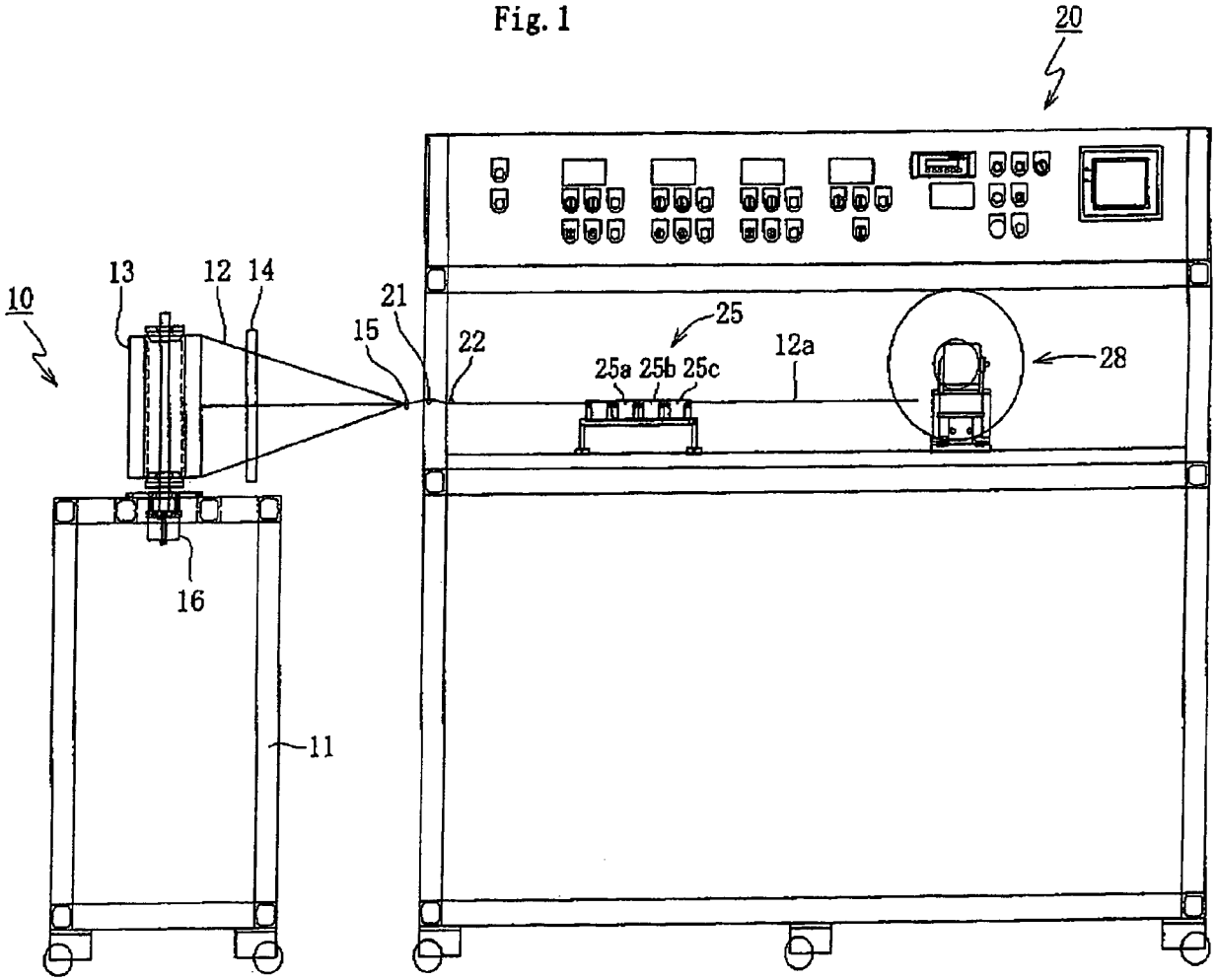
FIG. 1 is a front view of the airflow carding machine for a single spindle bundled fiber according to a first embodiment of the present invention.
Figure 2:
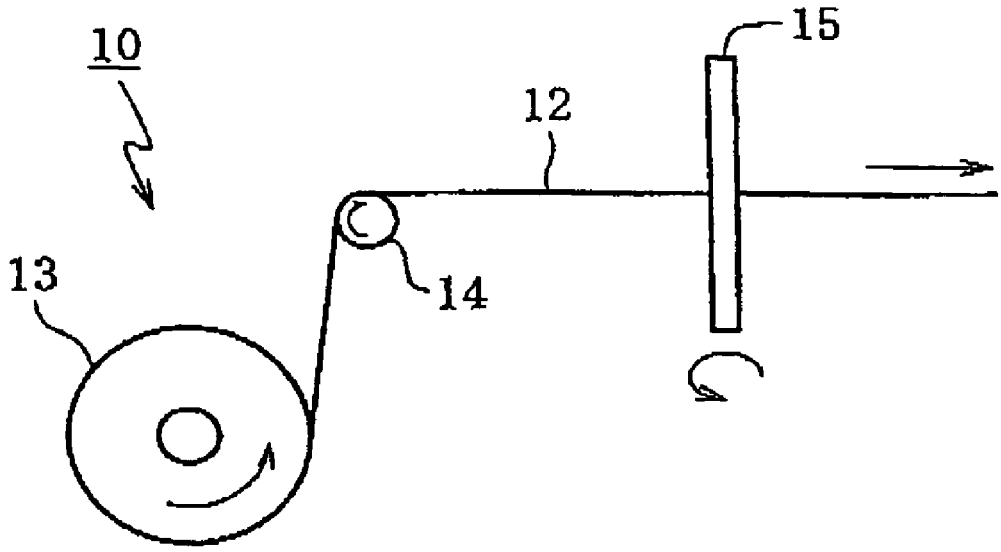
FIG. 2 is a schematic diagram of the supply unit of the machine shown in FIG. 1.

FIG. 1 shows a frontal view of the airflow carding machine for a single spindled bundled fiber according to a first embodiment of the present invention. In FIG. 1, a unit 10 is the bundled fiber feeding unit (filament feeding unit). As shown in the planar view of the key parts in FIG. 2, a feed roll 13, around which bundled fibers 12 composed of a large number of reinforced filaments, such as carbon fibers, bonded by a sizing agent are wound, is supported on a table 11 positioning a shaft of the feed roll 13 in a vertical direction and freely rotating around the shaft. A guide roll 14, which changes the moving direction of the bundled fibers 12 fed from the feed roll 13, by approximately 90 degrees in a planar view, and a shaft of the guide roll 14 is fixed vertically for the guide roll 14 to freely rotate around the shaft. A guide roll 15 which sends the bundled fibers 12 that are sent from the guide roll 14 to an airflow carding action unit 20 at a certain height, is fixed or freely rotating, as will be described later.

The feed roll 13 is equipped with an adjustable tension applying means 16, which applies tension to the bundled fibers 12, optimizing the tension applied to the bundled fibers 12 according to the properties and size of the reinforced filaments to form the bundled fibers 12 and the kind of the sizing agents used.

An airflow carding action unit 20 includes a plurality of guide rolls 21 and 22, a multistage airflow carding unit 25 that has more than one airflow carding unit (in the example drawing, three units of airflow carding units 25*a*, 25*b*, and 25*c*) aligned in series in the moving direction of the bundled fibers 12, and a rewind roll unit 28 that rewinds the carded sheet 12*a*, which is then carded in the multistage airflow carding unit 25.

Figure 3:
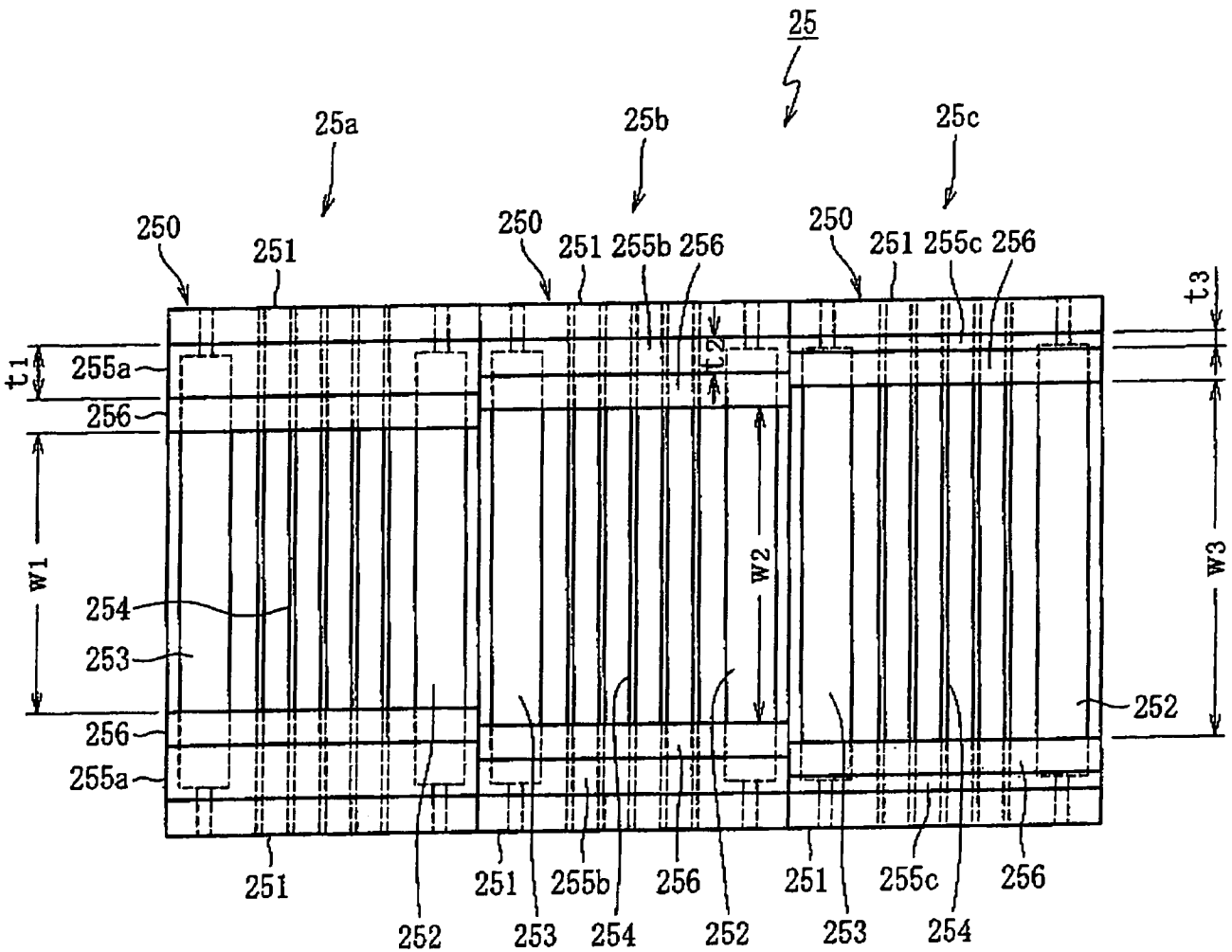
FIG. 3 is an enlarged planar view of the multistage airflow carding unit according to the machine shown in FIG. 1.
Figure 4A:
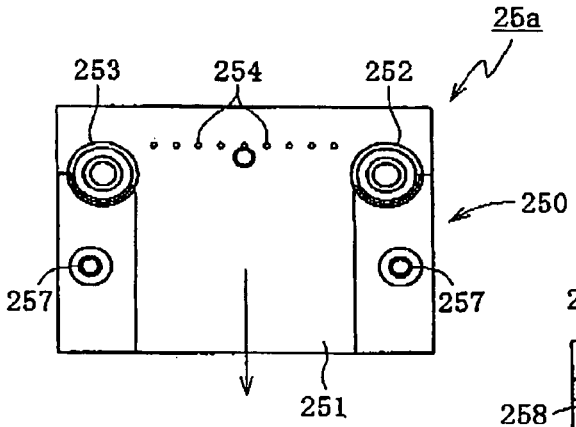
FIG. 4 (A) is a front sectional view of the first stage airflow carding unit of the multistage airflow carding unit shown in FIG. 3.
Figure 4B:
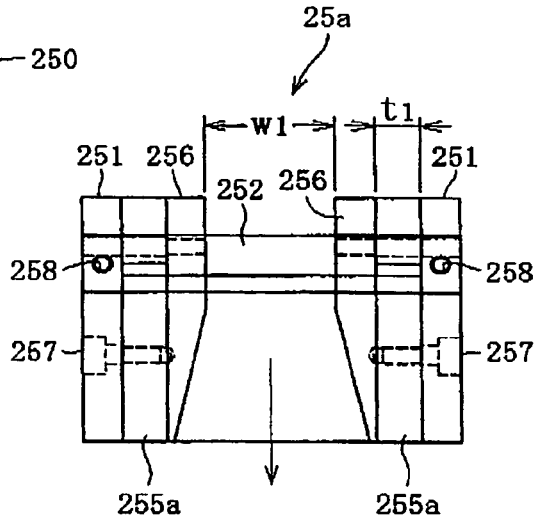
Figure 4C:
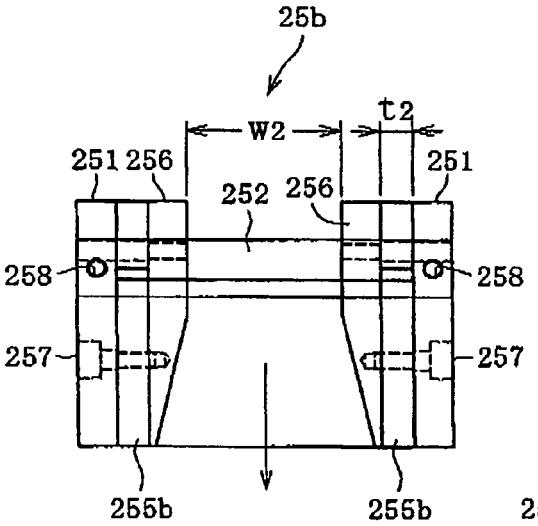
Figure 4D:
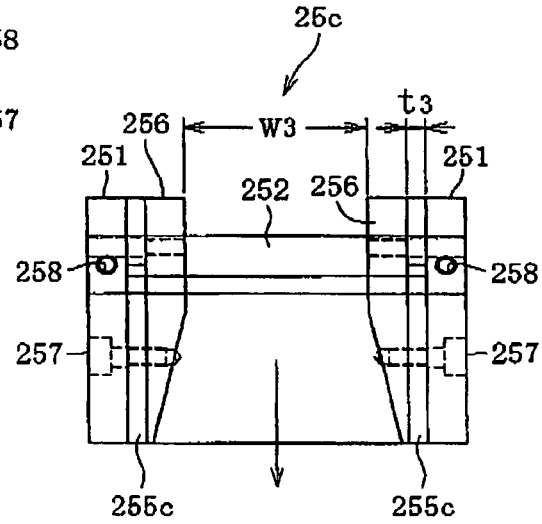

As shown in FIG. 3 and FIGS. 4 (A) to 4 (D), the multistage carding action unit 25 includes a multistage alignment of airflow carding units 25*a*, 25*b*, and 25*c*, in series, from an upstream end to a downstream end. As shown in FIG. 3 and FIGS. 4 (A) to 4 (D), a width of a moving path w1, w2, and w3 for the bundled fibers 12 in each airflow carding unit 25*a*, 25*b*, and 25*c* becomes broader as the path moves downstream in the moving direction of the bundled fibers (w1<w2<w3). Except for width, as will be described later, each airflow carding unit 25*a*, 25*b*, and 25*c* has a very similar structure.

Therefore, the exemplary airflow carding unit 25*a* will be referenced herein to describe aspects of the invention. For example, the airflow carding unit 25*a* has an airflow wind tunnel, such as a hollow rectangular wind tunnel 250, that forms a suction wind tunnel that suctions air from a lower side. The airflow carding unit 25*a* also includes large diameter guiding parts 252 and 253, which extend to sideboards 251 on both ends and are placed before and after the moving direction of the bundled fibers 12. The sideboards 251 are horizontal and orthogonal relative to the moving direction of the bundled fibers 12. The airflow carding unit 25*a* also includes more than one small diameter supportive part 254 placed at a certain interval between the guiding parts 252 and 253, in the same plane and horizontally relative thereto.

Guiding parts 252 and 253 and/or supportive part 254 can be fixed on sideboards 251 and 251 of the wind tunnel 250, or can be free to revolve around a shaft. If the guiding parts 252 and 253 and/or supportive part 254 are fixed to sideboards 251 and 251, the support structure is simplified, thereby cutting production cost. If the guiding parts 252 and 253 and/or supportive part 254 are able to freely rotate, as is sometimes desirable, depending on the property and size of the reinforced filament forming bundled fibers 12 and the kind of sizing agent, the moving and carding of bundled fibers 12 become smoother, reducing wear by friction with the bundled fibers 12 and preventing uneven wearing by constantly changing the friction location relative to the circumference direction.

Inside of each of sideboard 251 and 251, the guiding parts 256 and 256 regulate the crosswise movement of the bundled fibers 12 and are positioned by flexible spacer parts 255*a*, 255*b*, and 255*c* that are slightly higher than the guiding parts 252 and 253 to control the vertical positioning of the bundled fibers 12. Increasing the height of the guiding parts 256 and 256 provides the airflow in the airflow carding unit with a stable laminar flow and stabilizes the carding action of the bundled fibers 12. However, increasing the height beyond a certain level does not result in greater stabilization of the carding action by the stabilization of airflow. Rather, increasing the height too much gives rise to larger size and higher cost of the machine. Therefore, the height of the guiding parts 256 and 256 is to be determined according to the properties and size of the reinforced filament in the bundled fibers 12 and the kind of the sizing agent used.

The sideboards 251 and 251, spacer parts 255*a*, 255*b*, and 255*c*, and guiding parts 256 and 256 in the aforementioned airflow carding units 25*a*, 25*b*, and 25*c* are connected by bolts 257 and 257 so as to be easily dissembled. A screw hole 258, so as to fix the guiding parts, is drilled into sideboards 251 and 251 in each airflow carding units 25*a*, 25*b*, and 25*c*, such as to match the end of the moving direction of the bundled fibers.

Thickness t1, t2, and t3 of each spacer 255*a*, 255*b*, and 255*c* in the airflow carding units 25*a*, 25*b*, and 25*c*, are placed along the moving direction of the bundled fibers 12 in descending order t1>t2>t3. Namely, the thickness decreases in the moving downstream, such as where the width of moving path, w1, w2, and w3 for bundled fibers 12 formed between the guiding parts 256 and 256, are in the order of w1<w2<w3, where the width increases moving in the downstream direction. This configuration makes the width of the carded sheet 12*a* adjustable with the progress of the carding of the bundled fibers 12. Spacers 255*a*, 255*b*, and 255*c*, and guiding parts 256 and 256, are consolidated by bolts 257 and 257 to the sideboards 251 and 251 in order to allow for the sharing of components, except for the spacers, in the airflow carding units 25*a*, 25*b*, and 25*c*, giving added flexibility in the assembly and disassembly of the parts by exchanging the spacers 255*a*, 255*b*, and 255*c* with different thicknesses, t1, t2, and t3.

The carding action in the aforementioned airflow carding machine for the single spindled bundled fibers is described next. The bundled fibers 12 are drawn out from the feed roll 13 to change the moving direction by approximately 90 degrees within a horizontal plane by a guide roll 14 and is kept at a certain height by a guide roll 15 to draw out to the airflow carding action unit 20.

The bundled fibers 12 traveling through the guide rolls 21 and 22 that have a tape shaped or elliptical cross-section are drawn out in the moving direction to be carded at the airflow carding unit 25, forming the carded sheet 12*a*. The sheet 12*a* is composed of crosswise lining of each reinforced filaments, which are then rewound around a rewinding roll unit 28.

As bundled fibers 12 are drawn out from the feed roll 13, which is stacked in a vertical direction, the drawn out height of the bundled fibers 12 can be moved up and down. However, the bundled fibers 12 that are drawn out change their direction by approximately 90 degrees in planar view by a guide roll 14 that is stacked vertically, and are pressed from above and below by a guide roll 15 that is placed horizontally. Therefore, the bundled fibers 12 only pitch slightly at the entrance of guide roll 15. Furthermore, since the shaft of guide roll 15 is placed horizontally, the bundled fibers 12 are guided along the circumference of the guide roll 15. When compared to the conventional machine in which the shaft of both the feed roll A and the guide roll 2 is placed horizontally, as shown in FIGS. 19 (A) and 19 (B), swaying of the feed position for the bundled fibers 12 that are fed through guide roll 15 is extremely low. This leads to stabilization of the supply position in the bundled fibers 12 towards the airflow carding action unit 20. As in the conventional machine, the feed roll is not required to traverse towards the shaft direction and the required space for the installation of feed roll 13 is reduced.

Since a proper load level is applied to the feed roll 13 by the tension applying means 16, a proper level of tension is applied to the bundled fibers 12 drawn out from the feed roll 13. Both the tension by the tension applying means 16 at the feed roll 13 and the rewinding tension by the rewind roll unit 28 constantly apply proper tension to the bundled fibers 12 and the carded sheet 12*a*.

Figure 17:
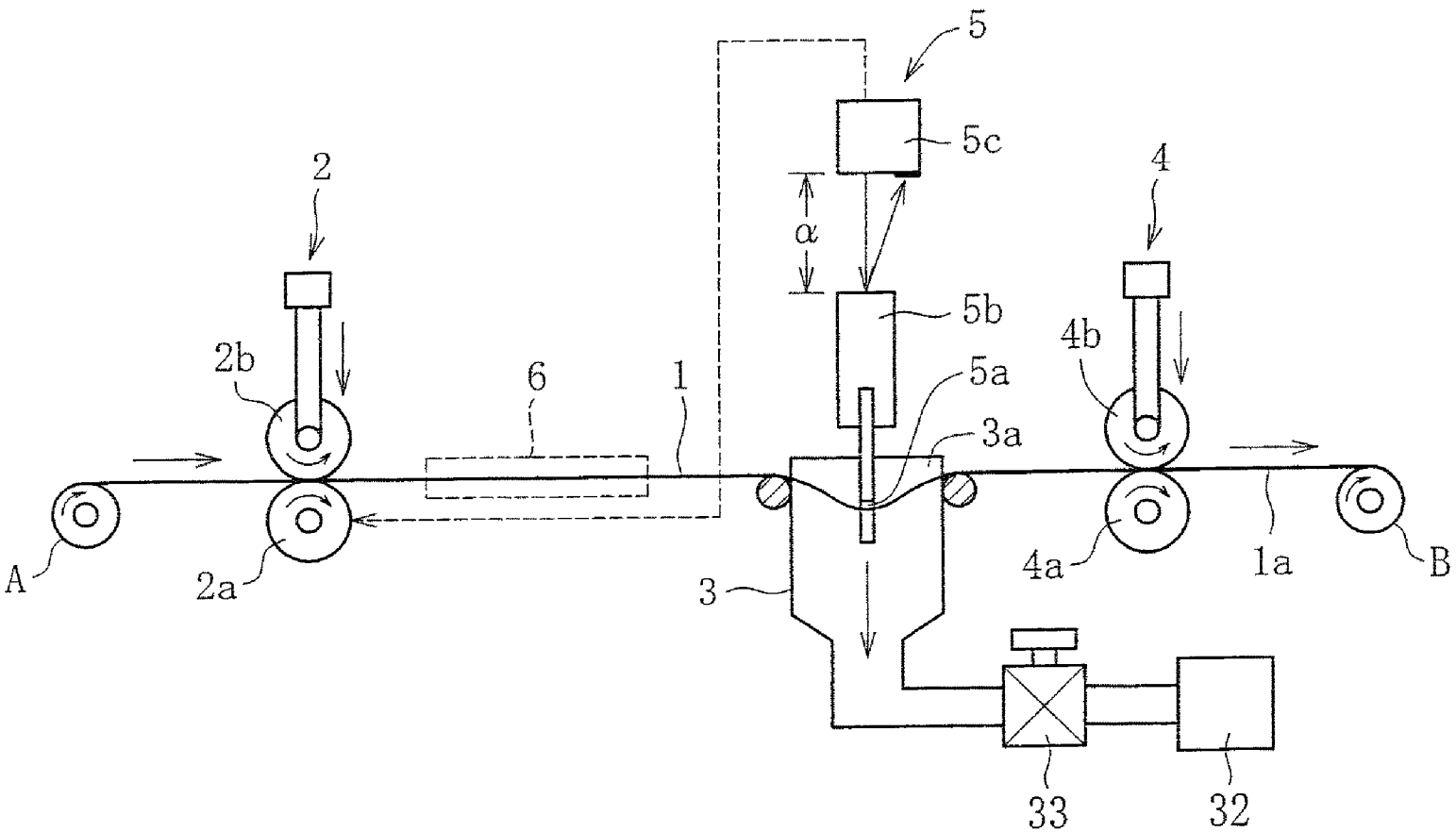
Fig. 17 (Prior Art)
FIG. 17 is a schematic frontal view of a conventional airflow carding machine.
Figure 18:
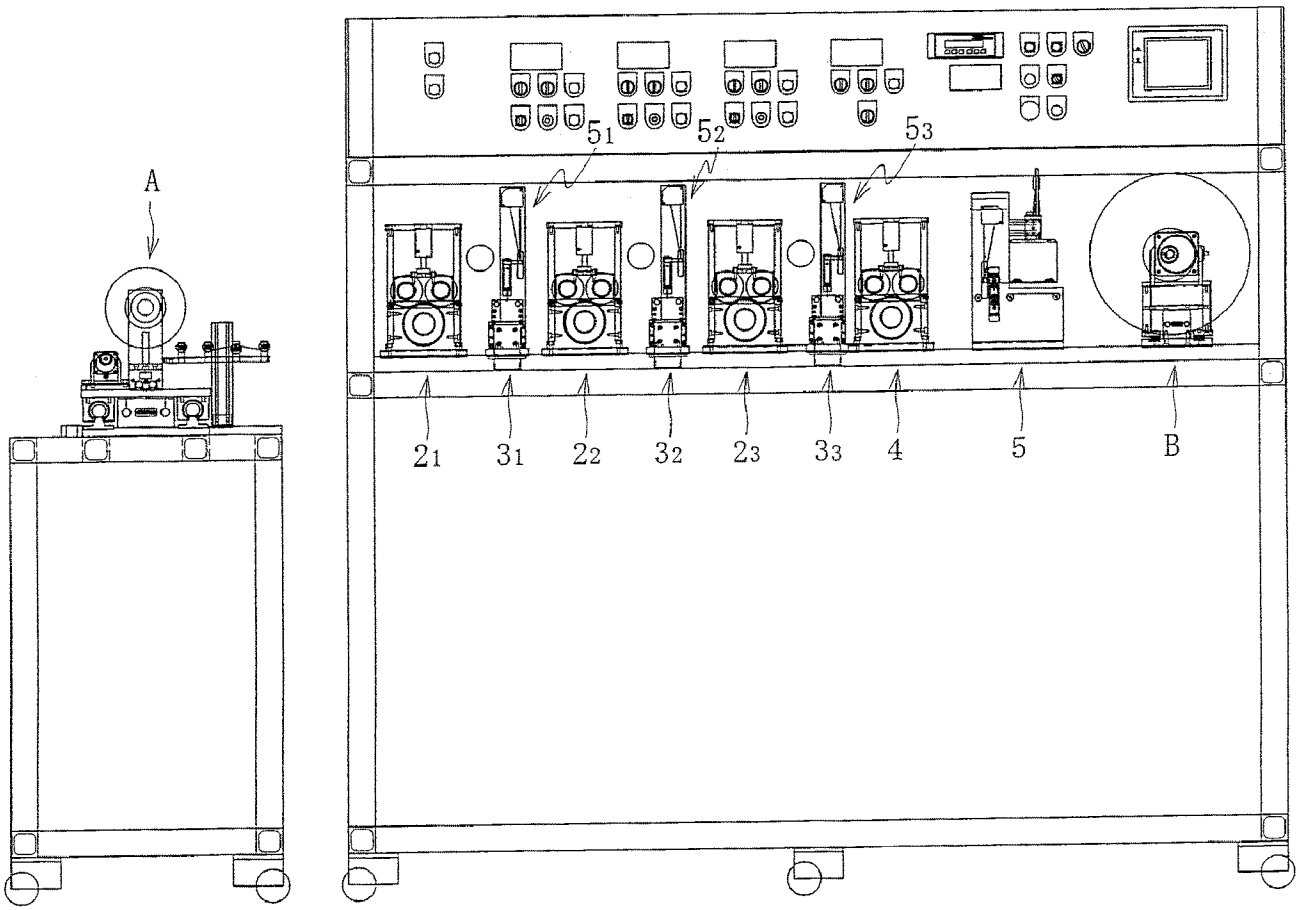
Fig. 18 (Prior Art)
FIG. 18 is a schematic frontal view of a conventional airflow carding machine for multistage bundled fibers.

Since each airflow carding unit 25*a*, 25*b*, and 25*c* in the multistage airflow carding unit 25 is equipped with guiding parts 252 and 253, and more than one supportive part 254 that is placed horizontally in a plane, a downward airflow in the suction wind tunnel keeps the bundled fibers 12 in contact with the planar and horizontal supporting part 254 so as to constantly maintain the bundled fibers 12 in a horizontal plane. Therefore, as shown in FIG. 17, the fiber height detection units 51, 52, and 53 are not required in the airflow carding units 25*a*, 25*b*, and 25*c*. Therefore, as in the conventional case, a detection signal is not required to feedback to the driver motor of the drive roll for front feeders 21, 22, and 23. The upstream front feeder and driver motor in each airflow carding unit 25*a*, 25*b*, and 25*c* can be omitted to drastically reduce the number of machine parts, shortening the total length of airflow carding action unit 20, and possibly achieving miniaturization, weight reduction, and lowering the cost of the airflow carding machine.

As described above, the fiber height of the bundled fibers 12 and carded sheet 12*a* are kept in a horizontal plane by guide parts 252 and 253, and more than one supporting part 254, in each airflow carding unit 25*a*, 25*b*, and 25*c*. Further, the bundled fibers 12 are smoothly carded in the airflow carding units 25*a*, 25*b*, and 25*c* by adjusting the tension applying means 16 of the feed roll 13 and the number of revolutions of the driver motor for the rewind roll unit 28. Adjusting the tension to a constant level in rewinding of the carded sheet 12*a* to the rewind roll unit 28 eliminates pitching of the rewound carded sheet 12*a* to yield a roll of high quality carded sheet 12*a*.

According to the carding machine for the single spindle multistage bundled fibers described above, the carding action, wherein the bundled fibers 12 or carded sheet 12*a* travel over each airflow carding unit 25*a*, 25*b*, and 25*c*, and pass over more than one supportive parts 254, is performed at small intervals, stepwise, and continuously when compared to the carding action by a conventional wind tunnel, leading to more reliable carding and an improvement in the quality of the carded product.

Since the bundled fibers 12 or carded sheet 12*a* travels over each airflow carding unit 25*a*, 25*b*, and 25*c* and is kept horizontal by more than one supportive part 254, it is not required to install a fiber height detection unit, in which a front feeder is installed upstream of each airflow carding unit, 25*a*, 25*b*, and 25*c* to detect the fiber height of the bundled fibers 12 or carded sheet 12*a* that travels over each airflow carding unit, 25*a*, 25*b*, and 25*c* and feedbacks the detected signal to a driver motor of the upstream front feeder. Along with the elimination in the need of the front feeder and its driver unit, it is also not necessary to have a processing and controlling unit for the detected signal. This not only simplifies its structure and reduces cost, but also eliminates the required space for installation, reducing its size, weight, and cost of the airflow carding machine for the bundled fibers. The beneficial effects become more obvious as the number of stage installed of the airflow carding units 25*a*, 25*b*, 25*c*, etc., for the multistage airflow carding unit 25 is increased.

If a wider carded sheet 12*a* is required, a plurality of feed rolls 13 placed in parallel may be used for the sheet. However, in the case where a shaft of the feed roll A is placed horizontally in the conventional airflow carding machine, as shown in FIG. 17 or FIG. 19, it is necessary to traverse the feed roll in the shaft direction orthogonal to its drawn out direction along with drawing out bundled fibers 12, resulting in a larger installation space per unit of feed roll being required. As mentioned previously, it is practically difficult to obtain the airflow carding machine with many feed rolls in parallel for the multiple spindle bundled fibers.

Second Embodiment

Figure 5A:
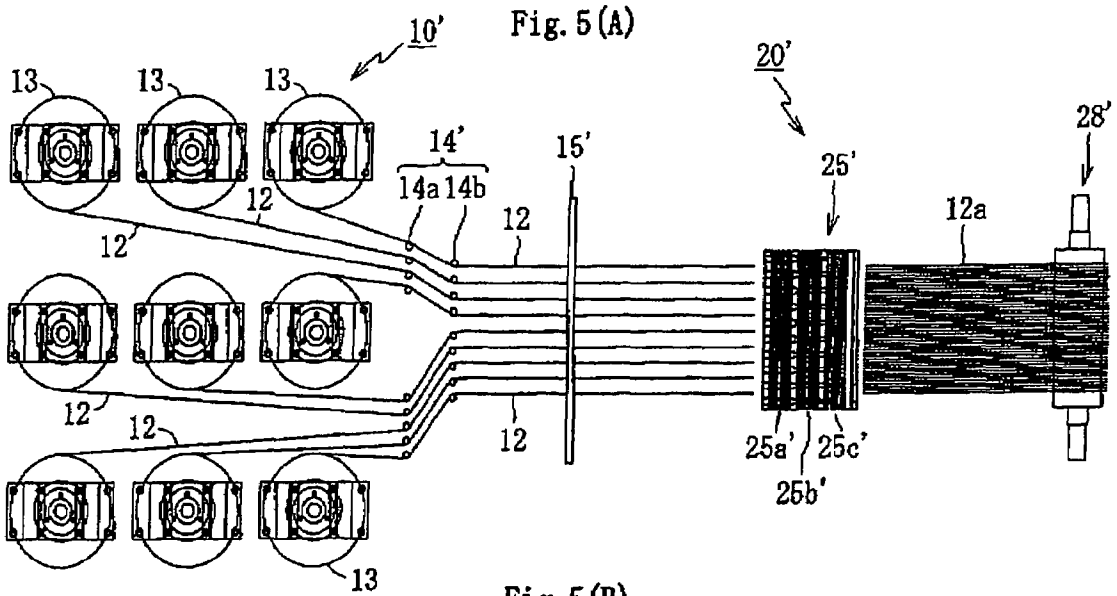
FIG. 5 (A) is a schematic diagram of the components in an airflow carding machine for multiple spindle bundled fibers according to a second embodiment of the present invention.
Figure 5B:
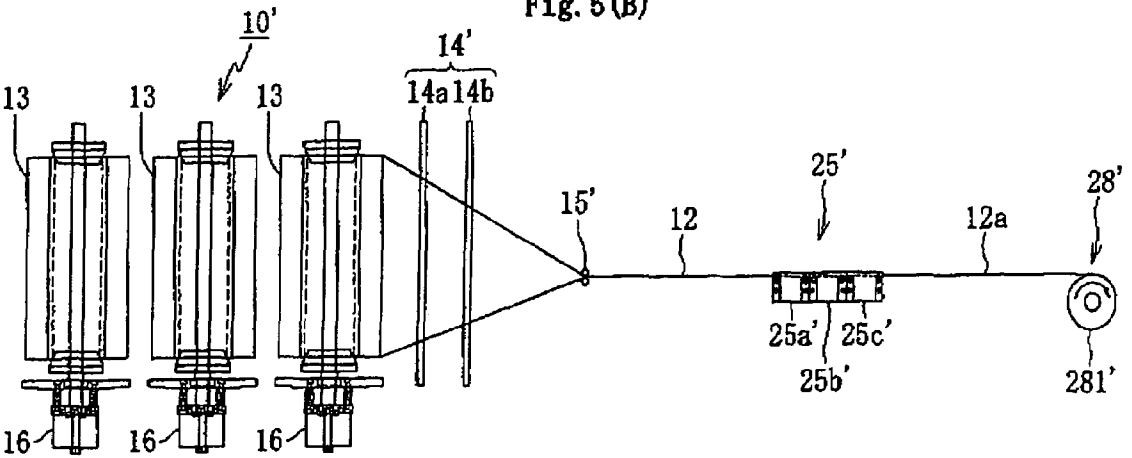

FIGS. 5 (A) and 5 (B) are schematic diagrams of the airflow carding machine for the multiple spindle bundled fibers, wherein use of a plurality of feed rolls makes production of a wider carded sheet possible. In FIGS. 5 (A) and 5 (B), the supply unit 10' of the bundled fibers (filament supply unit), wherein a plurality of feed rolls 13 are placed in the form of a matrix with each shaft being vertical. As a guide roll 14', two guide rolls 14*a* and 14*b* at the first stage and the second stage are installed according to the position of each feed roll 13 to differentially vary the angle of directional change by guide rolls 14*a* and 14*b*, such as to respond to the position of the feed roll 13 and 50 on, adjusting each bundled fiber 12 that is drawn out from the second stage guide roll 14*b* to move in parallel and horizontally. The guide roll 15' is relatively long in order to guide the plurality of bundled fibers 12.

Figures 6A, 6B, 6C:
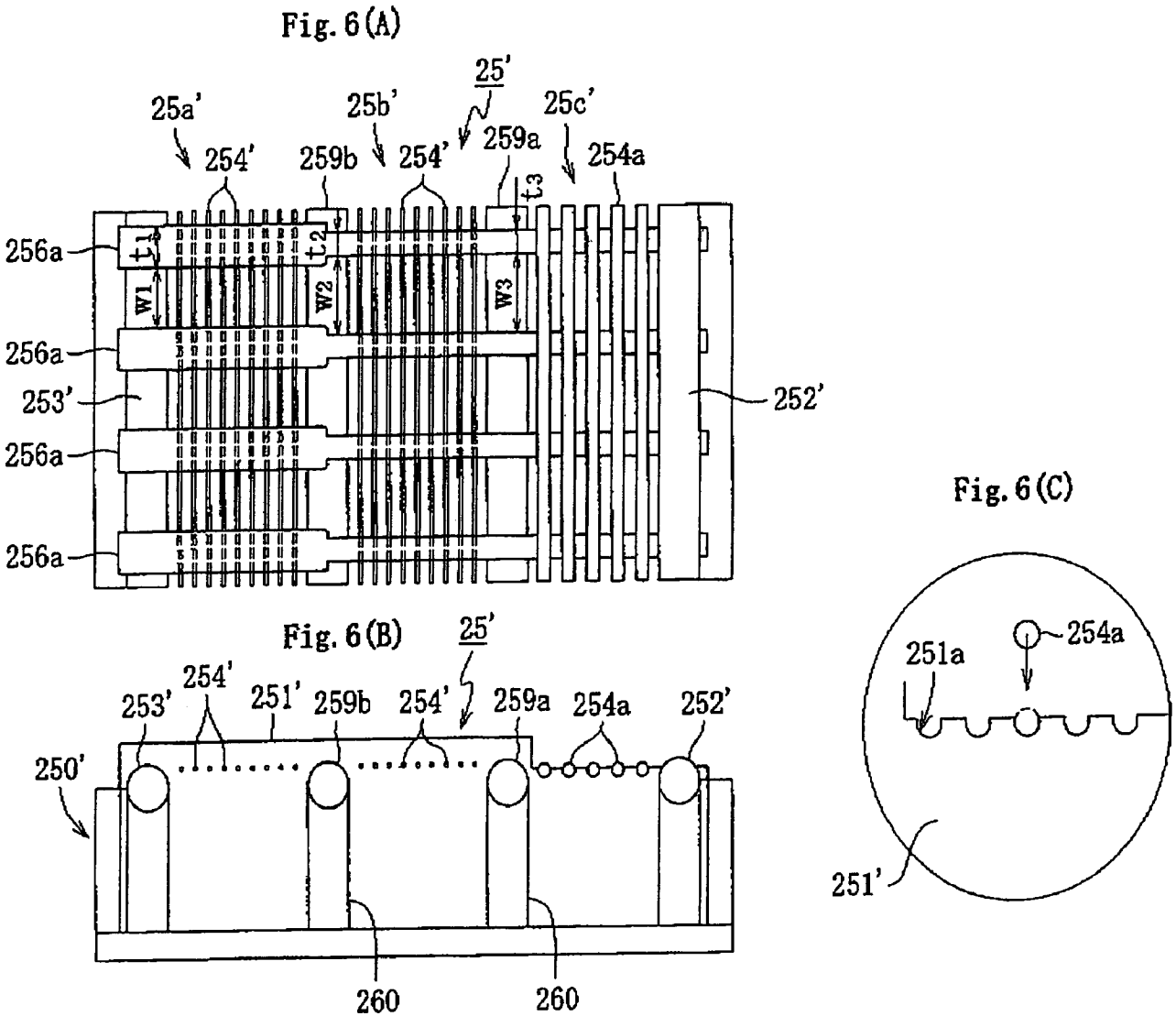
FIG. 6 (A) is an enlarged planar view of a sequentially integrated airflow carding unit in the airflow carding machine shown in FIG. 5.

As shown in FIGS. 6 (A) and 6 (B), the multistage carding unit comprises a plurality of stage carding units 25*a*', 25*b*', and 25*c*' arranged in series along the moving direction of the bundled fibers 12, as well as in parallel in a form of many units, orthogonal relative to the moving direction of bundled fibers 12 to form a sequentially integrated airflow carding machine 25'. The sequentially integrated airflow carding machine 25' is equipped with long common guiding parts 252' and 253'; two common space filling guiding parts 259*a* and 259*b* placed at a certain interval between common guiding parts 252' and 253'; multiple long supporting parts 254*a*, 254', and 254' that are horizontally placed at certain intervals, respectively, between common guiding parts 252' in the aforementioned front end and space filling guiding part 259*a*, between common space filling guiding parts 259*a* and 259*b*, and between common space filling guiding part 259*b* and common guiding part 253' in the back end more than one common guiding part 256*a* across three stage airflow carding units 25*a*', 25*b*', and 25*c*'; and dividing board 260 that separates the suction wind tunnel for airflow carding units 25*a*', 25*b*', and 25*c*', at each stage. Common guiding parts 252' and 253', space filling common guiding parts 259*a* and 259*b*, and supportive parts 254*a*, 254', and 254' can be fixed to sideboards 251 and 251', or allowed to freely rotate, for the same reason described previously.

Supportive parts 254' and 254' that are placed between the space filling common guiding parts 259*a* and 259*b*, and between the space filling common guiding part 259*b* and the common guiding part 253', are small in diameter, as depicted in FIG. 3 and FIG. 4. However, the supporting part 254*a* that is placed between the common guiding part 252' and the space filling common guiding part 259*a* is larger in diameter than the supporting part 254'. This configuration emphasizes an increase in carding efficiency by using a smaller diameter supportive part 254' in the first stage airflow carding unit 25*a*' and the second stage airflow carding unit 25*b*, which increases the airflow area in the wind tunnel and eases the suction airflow through the bundled fibers 12, as well as between each reinforced filament of the carded sheet 12*a* that travels through the suction wind tunnel. In addition, because carding in the third stage airflow carding unit 25*c*' is fairly progressed, it mainly retains the carded sheet 12*a* in a horizontal position rather than increasing the carding effect.

As shown in FIG. 6 (C), the supportive part 254*a* in the third stage airflow carding unit 25*c*' is positioned in semicircular grooves 251*a* and 251*a* defined at the upper ends of sideboards 251' and 251'. Since the supportive part 254*a* protrudes above the tops of the sideboards 251' and 251', the carded sheet 12*a* that travels over the sideboard 251, 251', receives the carding action over the continuous wind tunnel tube without the dividing board, making the adjacent carded sheets align tightly, without a void between them, yielding a continuously aligned carded sheet.

Each common guiding part 256*a* along the moving direction of the bundled fibers 12 is set up with thickness t1, t2, and t3 for the first stage airflow carding unit 25*a*', the second stage carding airflow unit 25*b*', and the third stage airflow carding unit 25*c*', respectively, such as t1>t2=t3. Therefore, width w1, w2, and w3 between each common guiding part 256*a* and 256*a* of the moving path of the bundled fibers 12 and carded sheet 12*a* has a setup of w1<w2=w3.

In the above described carding machine for the multiple spindle bundled fibers, bundled fibers 12 are drawn out from a plurality of feed rolls 13 and so on, changing its direction by each guide roll 14' (14*a* and 14*b*), passing through guide roll 15' to be continuously carded at the first, second, and third airflow carding units 25*a*', 25*b*', and 25*c*' in the sequentially integrated airflow carding unit 25' and rewound around rewind roll unit 281' of the rewind roll unit 28'.

Therefore, the airflow carding machine for the multiple spindle bundled fibers, which was previously difficult to obtain, can now be accomplished. More specifically, the sequentially integrated airflow carding unit 25' has neither multistage alignment of the first stage, second stage, and third stage airflow carding units 25*a*', 25*b*', and 25*c*' in series, as depicted in FIG. 3, nor is the alignment of each airflow carding unit in parallel in the widthwise direction. Rather, it commonly shares the space filling common guiding parts 259*a* and 259*b* and the common guiding part 256*a* to construct the sequentially integrated structure, resulting in the simplification of the composition, miniaturization, weight reduction, and control of cost increases, in comparison to one with a comparable number of the sequential units in series or in parallel.

Even when the supportive parts 254' and 254*a* are placed horizontally, the bundled fibers 12 travel over more than one supporting part 254' and 254*a* placed in a small interval, applying the carding action in the conventional wind tunnel pipe stepwise at short intervals and continuously, to make carding reliable and improve the carding quality. In comparison to the case where the airflow direction is using a crescent alignment, the height of the single sequential airflow carding unit 25' is reduced.

Third Embodiment

Figure 7:
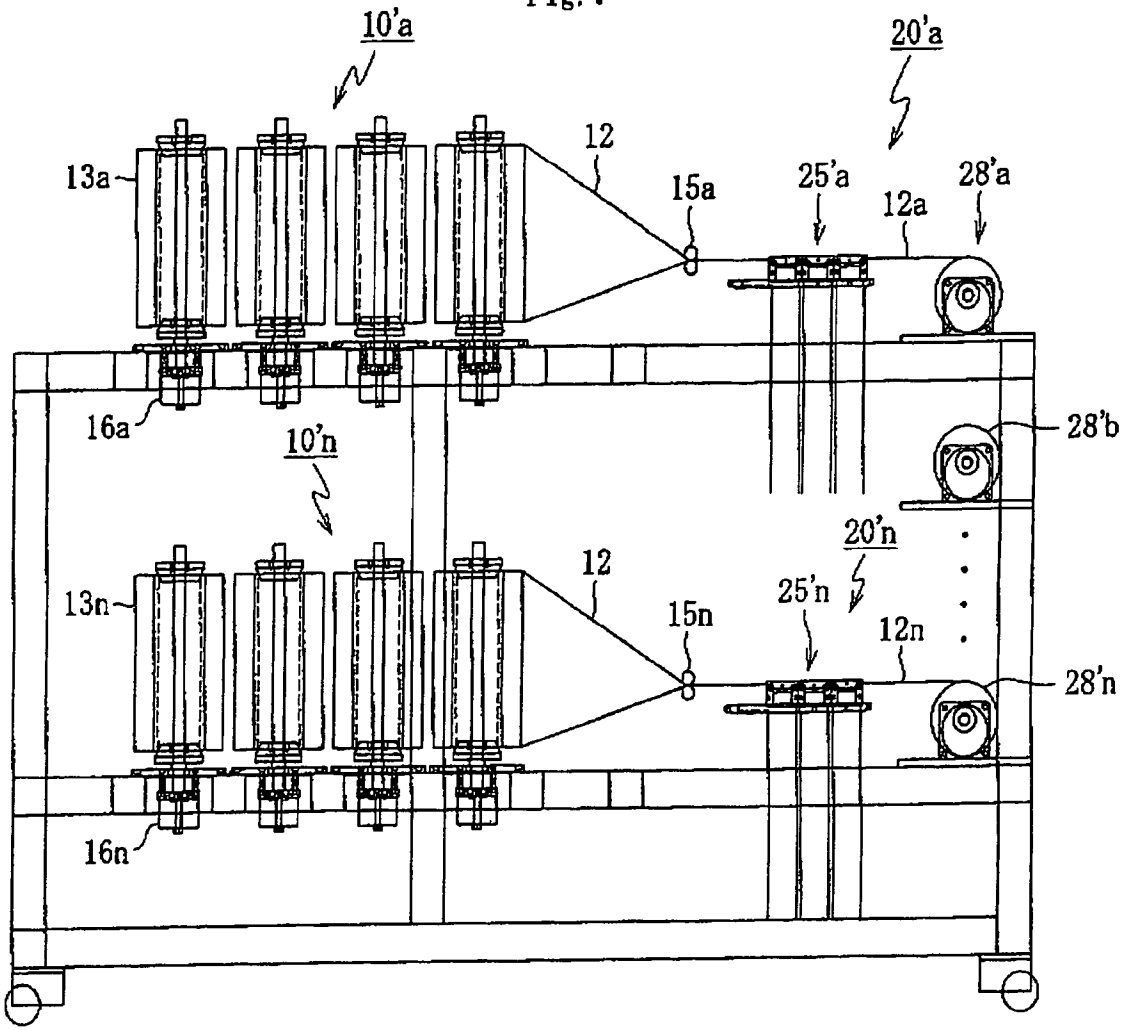
FIG. 7 is a schematic diagram of a multistage airflow carding machine for a double decked form of the multiple spindle bundled fibers according to a third embodiment of the present invention.

FIG. 7 shows a schematic diagram of the airflow carding machine for the multiple spindle bundled fibers, wherein multiple airflow carding machines for the multiple bundled fibers are placed in a double decked alignment at certain intervals to eliminate operational shutdown during the exchange of feed rolls 13*a*, 13*b*, etc.

Namely, as the bundled fibers 12 on feed roll 13*a* runs out, the empty feed roll 13*a* is detached and a new feed roll 13*a* has to be put in its place, but the carding machine has to be stopped during this exchange of feed roll 13*a*. Since the airflow carding machine for the multiple spindle bundled fibers is equipped with many feed rolls 13*a*, the time required for the exchange of feed roll 13*a* becomes longer and the duration of machine stoppage also becomes longer. Then, in the airflow carding machine for the multiple spindle bundled fibers in FIG. 7, more than one feed unit for the bundled fibers, 10'*a*, . . . , 10'*n*, and more than one airflow carding action unit, 20*a*', . . . , 20'*n*, and more than one rewind roll unit, 28'*a*, . . . , 28'*n* are placed in a multistage arrangement in double decked form at certain intervals.

Therefore, while bundled fibers 12 are carded by feeding the upper feed unit of the bundled fibers (filament feed unit) 10'*a* and in the upper airflow carding action unit 20'*a*, the bundled fibers 12 are also put on the lower feed unit of the bundled fibers (filament feed unit), 10'*b*, . . . , 10'*n* and in the airflow carding action unit, 20'*b*, . . . , 20'*n*. Immediately after the carding process by the upper feed unit of the bundled fibers 10'*a* and the upper airflow carding action unit 20'*a* is completed, carding of the bundled fibers 12 is initiated in the lower feed unit of the bundled fibers (filament feed section) 10'*b* and the lower airflow carding action unit 20'*b*. When the bundled fibers 12 are carded in the lower feed unit of the bundled fibers (filament feed unit) 10'*b*, and the lower airflow carding action unit 20'*b*, the bundled fibers 12 are put on the upper feed unit of the bundled fibers (filament supply unit) 10'*a* and the airflow carding action unit 20'*a*. Hence, the bundled fibers 12 are continuously carded.

As the number of upper and lower stages has more surplus, the bundled fibers 12 can be simultaneously carded on more than one feed unit of the bundled fibers (filament feed unit) 10' and the airflow carding action units 20'. It is also possible that both an upper stage and a lower stage setup are set in combination and alternately operated, to card bundled fibers in every other spindle and rewind around a rewind roll the carded reinforcing filaments that are carded in every other spindle, without a void existing between them, continuously producing a carded sheet.

In the embodiment shown in FIG. 7, an example wherein the bundled fibers 12 and the carded sheet 12*a* travel horizontally from the left end of the figure to rewind around the rewind roll unit 28 at a right end, is described. It is also possible that at least the airflow carding units 25'*a* and 25'*b* are vertically placed such that the bundled fibers 12 travel from top to bottom in one unit, then travel from bottom to top in another, changing the moving direction of the bundled sheets 12*a* and 12*b* sent from the upper and lower airflow carding units 25'*a* and 25'*b* by 90 degrees. By changing the direction of roll so that it travels horizontally, a pair of carded sheets 12*a* and 12*b* in parallel can be aligned to yield a single wide carded sheet. Alternatively, each reinforcing filament for the carded sheet 12*a* and that of the carded sheet 12*b* are alternately placed in the odd and even number positions, respectively, to produce a wide carded sheet.

Fourth Embodiment

Figure 8:
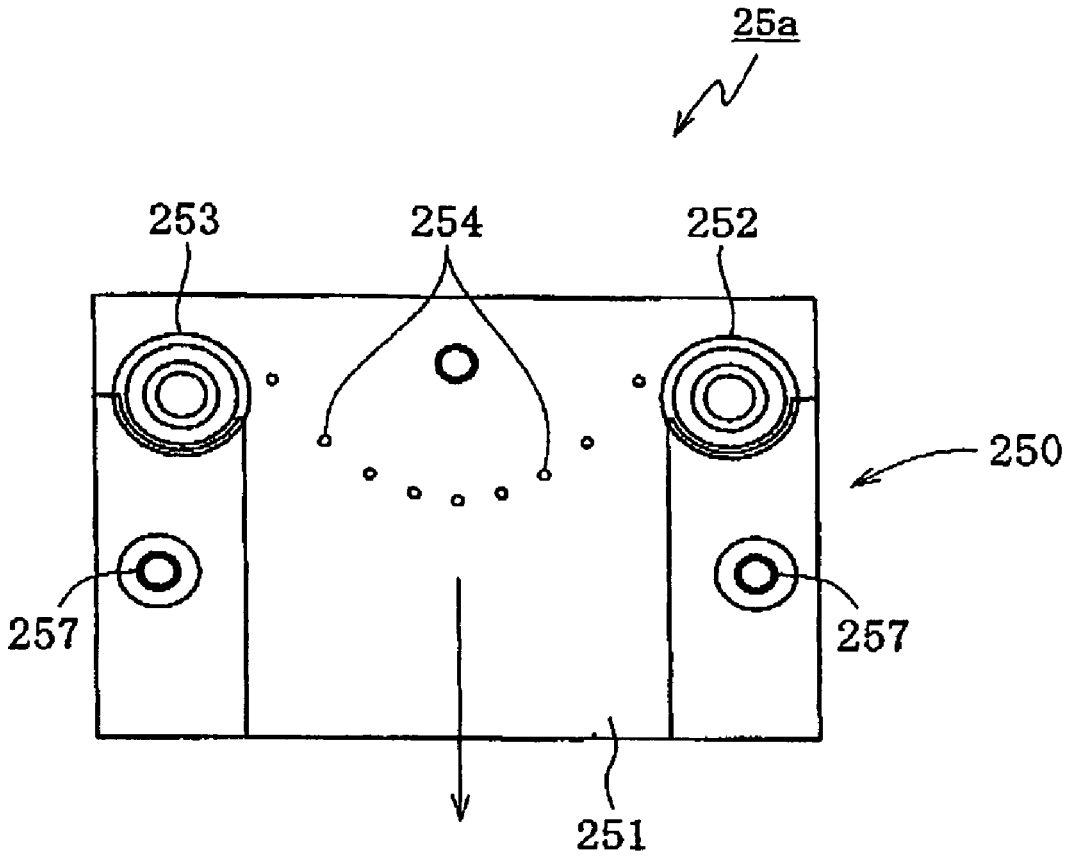
FIG. 8 is a front sectional view of an airflow carding unit according to a fourth embodiment of the present invention.

In the above discussed embodiment, the case, wherein more than one supportive part 254, 254', and 254*a* in the airflow carding units 25, 25*a*, 25*b*, 25*c*, 25'*a*, 25'*b*, and 25'*c* are placed in a plane and arranged horizontally along the moving direction of the bundled fibers 12 and carded sheet 12*a*, is described. However, as shown in FIG. 8, multiple supporting parts 254 can be placed in a convex crescent form against the airflow direction. The airflow carding unit with convex placement of the supportive unit can be a single carding machine for the bundled fibers, as shown in FIG. 1, a multistage airflow carding machine, as shown in FIG. 3, a multistage multiple sequential airflow carding machine, as shown in FIG. 5, or a double decked multistage carding machine for the multiple spindled bundled fibers, as shown in FIG. 7. In these cases, it is possible that the tension of the feed roll 13 and the rewind tension can properly be adjusted by the tension applying means 16 and the rewind roll unit 28, respectively, transforming the bundled fibers 12 and carded sheet 12*a* into a convex crescent form along multiple supportive parts that are placed in a crescent form. As in the case where more than one supportive part is placed horizontally, the fiber height detection unit, the upstream feed roll, and the downstream feed roll is not necessary and omitted.

Fifth Embodiment

Figure 9:
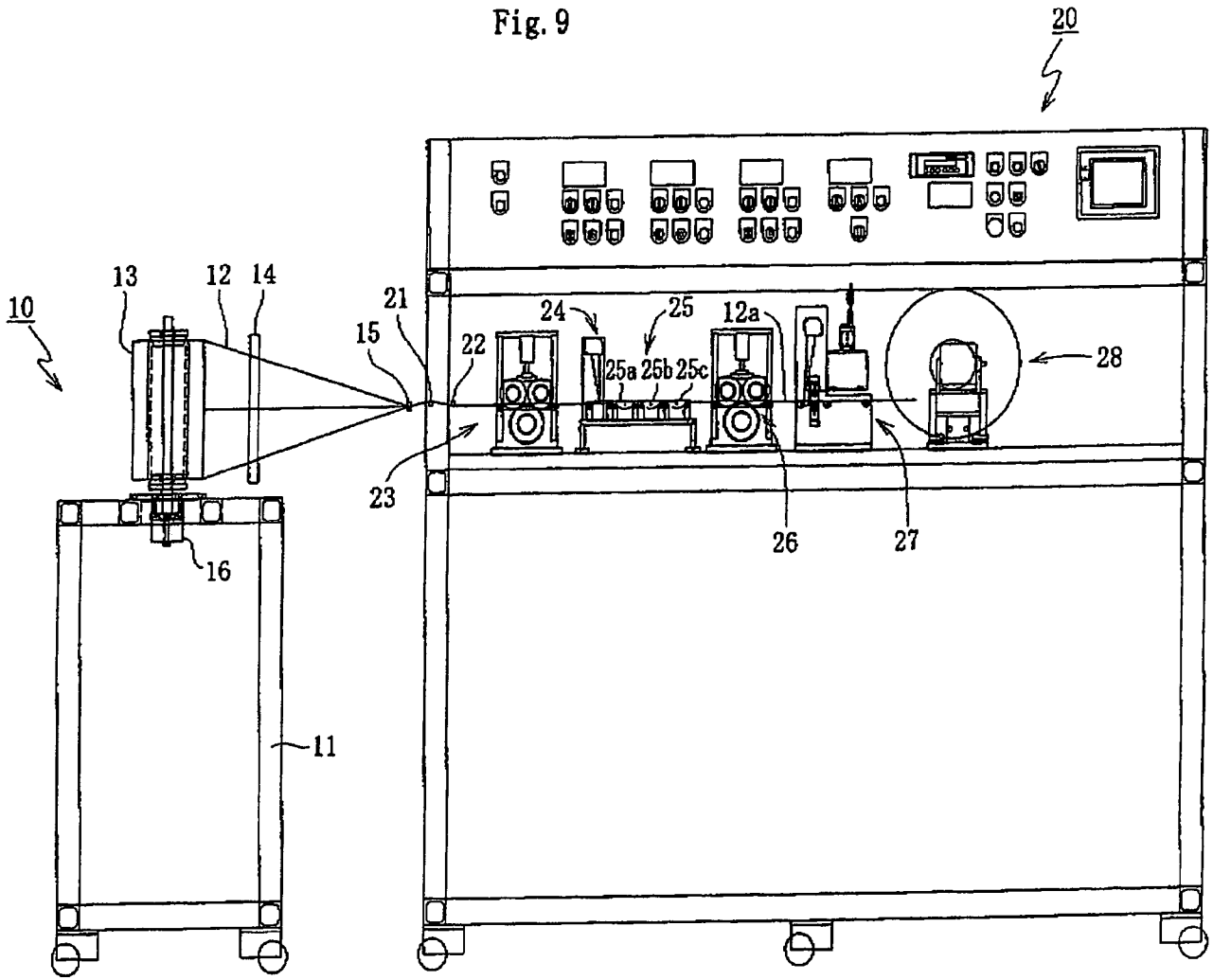
FIG. 9 is a schematic diagram of an airflow carding machine according to a fifth embodiment of the present invention, wherein the airflow carding unit shown in FIG. 8 is used.

As shown in FIG. 8, it is possible to place more than one supportive part 254 in a crescent form, where if necessary, an upstream feed roll unit 23 can be placed downstream of the guide rolls 21 and 22, as shown in FIG. 9. Downstream of the feed roll unit 23, namely upstream of the airflow carding unit 25, the fiber height detection unit 24 can be placed, or downstream of the fiber carding unit 25, the downstream feed roll unit 26 and the fiber height detection unit 27 can be placed.

Figure 10:
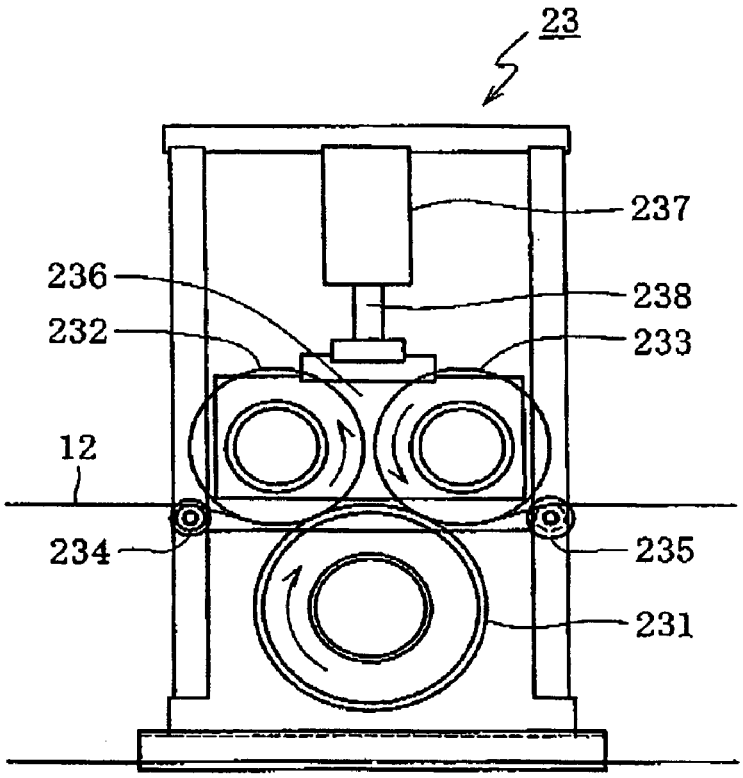
FIG. 10 is a schematic diagram of a front feeder in the airflow carding machine shown in FIG. 9.

Since the upstream feed roll unit 23 and the downstream feed roll unit 27 have the same composition, the upstream feed roll unit 23 will be described as an example. As shown in FIG. 10, the feed roll unit is comprised of the drive roll 231, freely revolving rolls 232 and 233, guide rolls 234 and 235, retaining part 236, and air cylinder 237. The drive roll 231 is driven by a driver motor, which cooperates with the freely rotating rolls 232 and 233 to draw out the bundled fibers 12. Guide rolls 234 and 235 feed the bundled fibers 12 from a certain direction to the space between the drive roll 231 and the freely rotating rolls 232 and 233. Retaining part 236 holds the freely rotating rolls 232 and 233 and air cylinder 237 as an actuator to raise or lower the retaining part 236, and raising and lowering of the holding part by the piston rod 238 of the air cylinder 237 applies a required load to the freely rotating rolls 232 and 233 against the drive roll 231 to send the bundled fibers 12 downstream.

Figure 11:
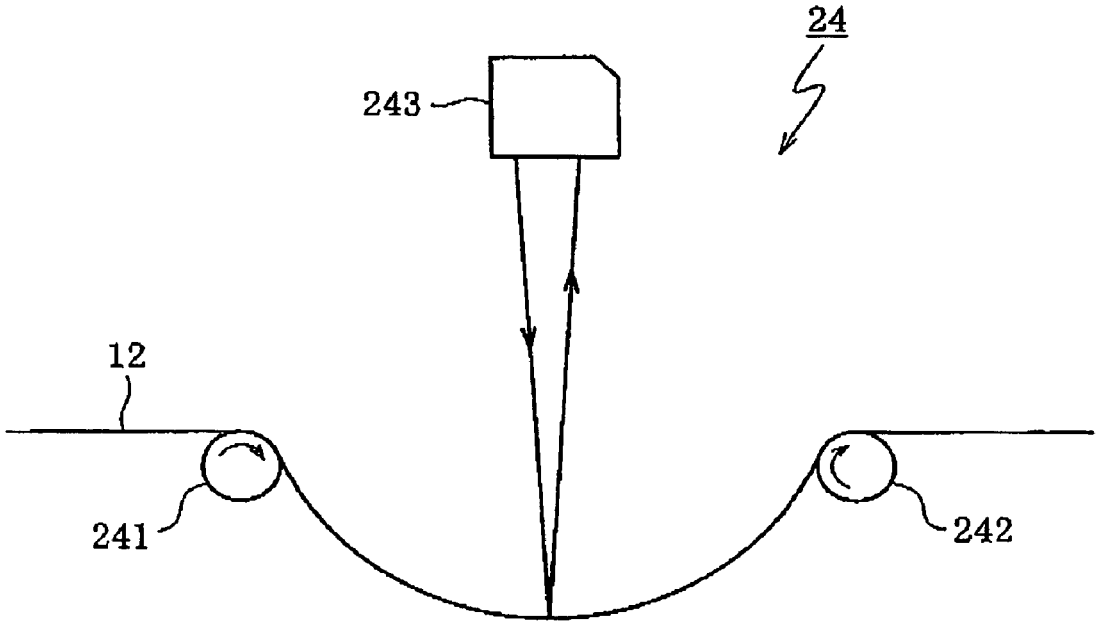
FIG. 11 is a schematic diagram of a fiber height detection unit in the airflow carding machine shown in FIG. 9.

Fiber height detection units 24 and 27 have the same structural configuration and the fiber height detection unit 24 will be described herein as an example. As shown in FIG. 11, the fiber height detection unit 24 is equipped with a pair of fixed or freely rotating guide rolls 241 and 242 that are placed before and after the moving direction of the bundled fibers 12 at a certain interval to move the bundled fibers 12 over the guide rolls 241 and 242. Then, the bundled fibers 12 that have been sent by the feed roll unit 23 under an overfed condition, is bent into a crescent form by the airflow between guide rolls 241 and 242, where the level of the bending of the bundled fibers is detected by a photoelectric or displacement sensor 243.

While the carding machine for single bundled fibers shown in FIG. 9, mentioned above, performs essentially the same carding action as the carding machine for the single bundled fibers depicted in FIG. 1, functional differences in the installation of the upstream feed roll unit 23, the fiber height detection unit 24, the downstream feed roll unit 26, and the fiber height detection unit 27 will now be described. The mass that is fed by the upstream feed roll unit 23 is set slightly larger than that by the downstream feed roll unit 26, leading to an overfed condition. Therefore, the bundled fibers 12 can be bent as much as the overfed mass in the fiber height detection unit 24 and the multistage carding machine unit 25. The bent condition in the fiber height detection units 24 and 27 can be stabilized by the action of the suction system or through lightweight superposition.

The fiber height detected by the fiber height detection unit 24 is sent to the drive roll 231 of the feed roll unit 23, as shown in FIG. 10, wherein starting or stopping the drive motor allows for the adjustment of the mass of the fed bundled fibers 12, optimizing the overfed mass to a proper amount.

The fiber height of the carded sheet 12*a* that is detected by the fiber height detection unit 27 is sent to the driver motor of the rewind roll unit 28 to adjust the rewind tension of the carded sheet 12*a* by rewind roll unit 28 to be constant. This eliminates pitching of the carded sheet 12*a* that is rewound to yield a roll of high quality carded sheet 12*a*.

Sixth Embodiment

Figure 12A:
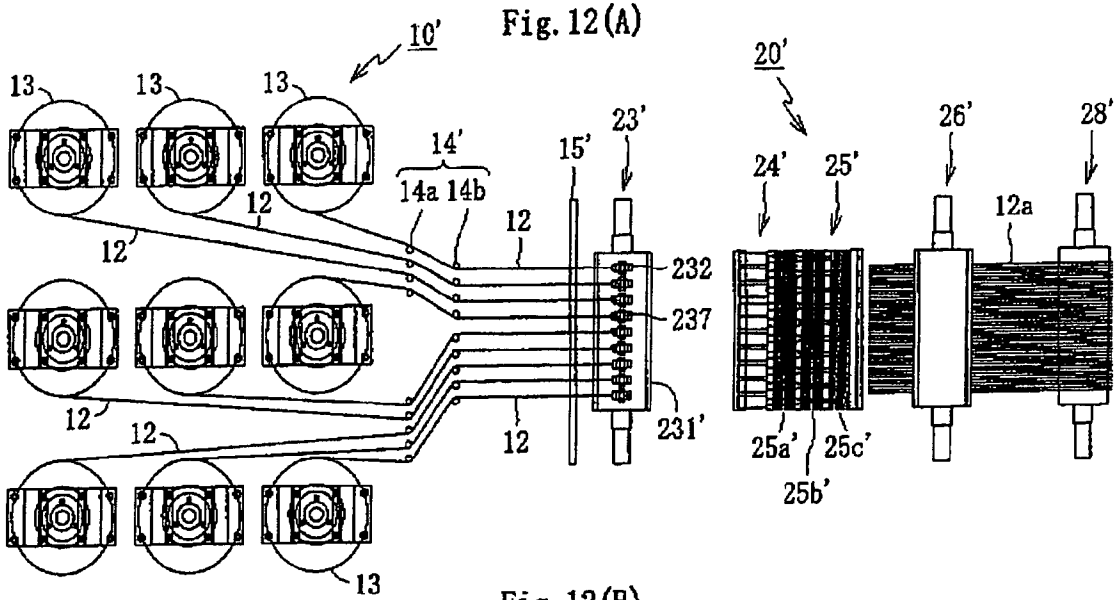
FIG. 12 (A) is a schematic diagram of a carding machine for the multiple spindle bundled fibers according to a sixth embodiment of the present invention.
Figure 12B:
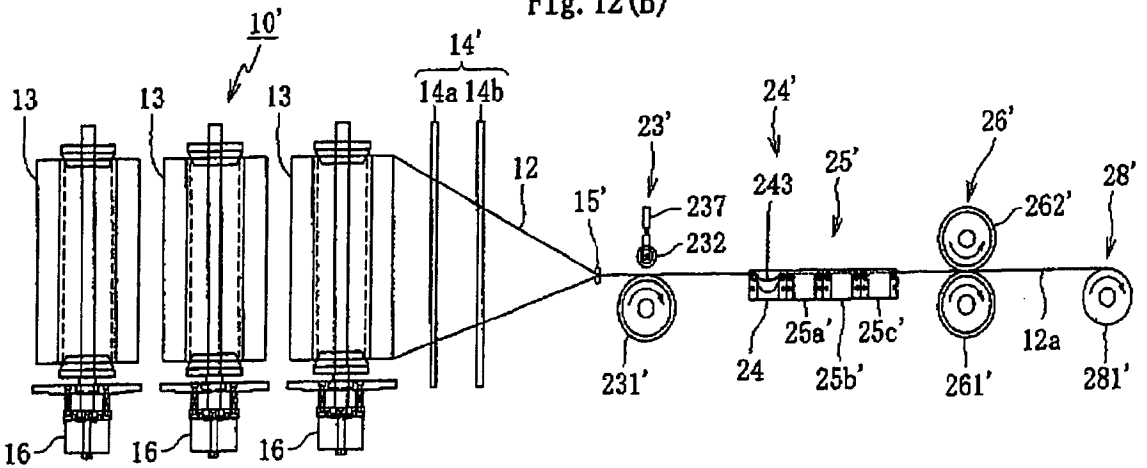

As shown in FIGS. 12 (A) and 12 (B), the carding machine for the multiple spindle bundled fibers can have an upstream feed roll unit 23', a fiber height detection unit 24', and a downstream feed roll unit 26'.

Figure 13C:
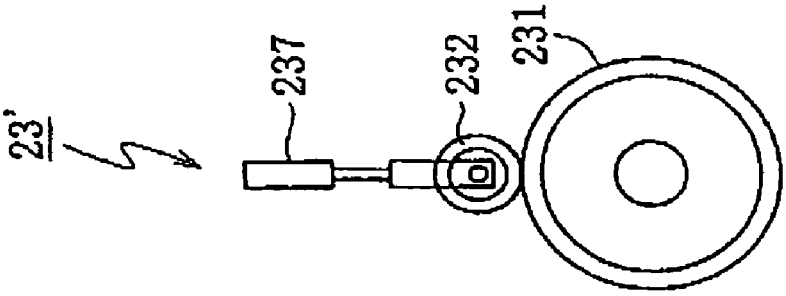
FIG. 13 (A) is a side view of an upstream feed roll in a stationary state of the bundled fibers in the airflow carding machine for the multiple spindle bundled fibers shown in FIG. 12.
Figure 13B:
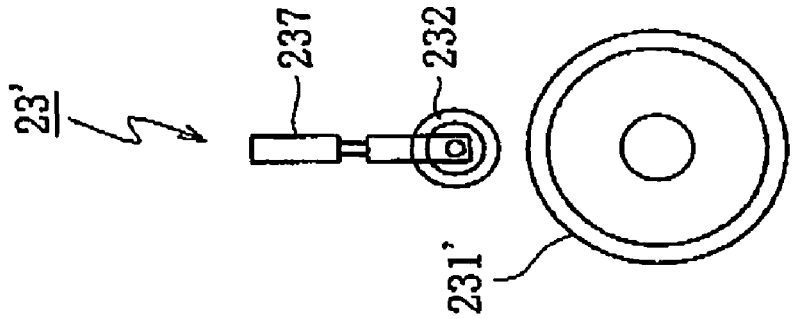
Figure 13A:
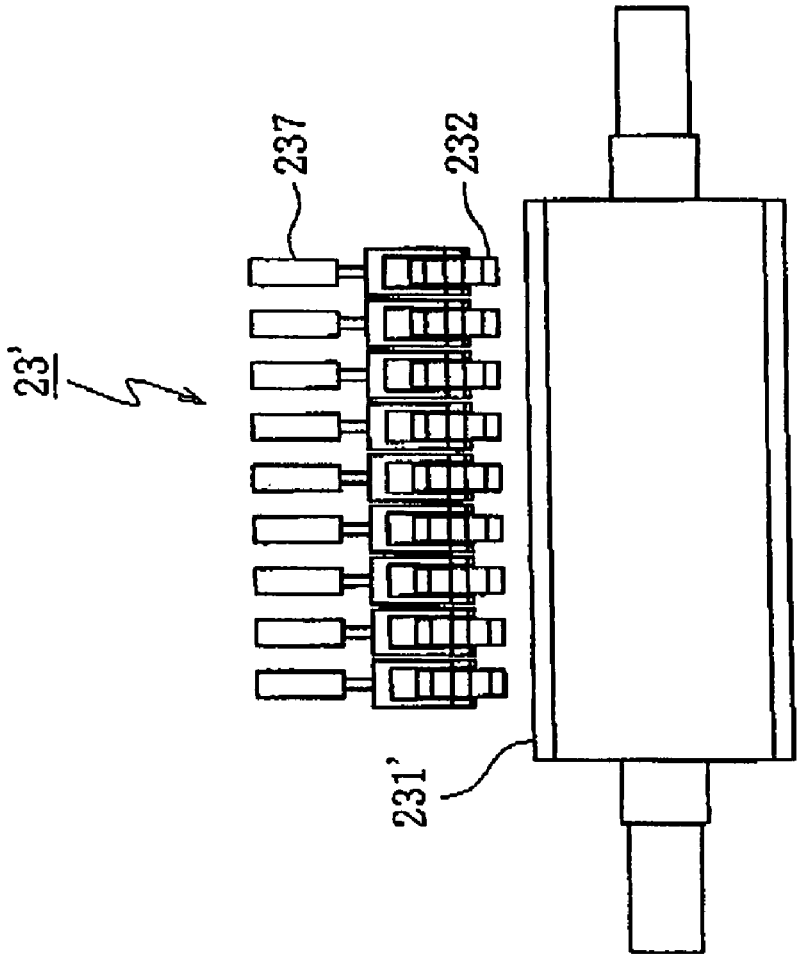

As shown in FIG. 13 (A), the upstream feed roll unit 23' includes a relatively long common drive roll 231', a plurality of separate, freely rotating rolls 232 for each bundled fibers 12, and a plurality of separate air cylinders 237 separate, freely rotating rolls 232. When the overfed amount of the bundled fibers 12 is substantial, as shown in FIGS. 13 (A) and 13 (B), each separate freely rotating roll 232 is raised by each separate air cylinder 237 to temporarily stop the feeding of the bundled fibers 12. As the amount of overfed mass becomes a proper value, as shown in FIG. 13 (C), each separate air cylinder 237 pushes down each separate freely rotating roll 232 in cooperation with the drive roll 231' to independently draw out the bundled fibers 12.

Seventh Embodiment

Figure 14:
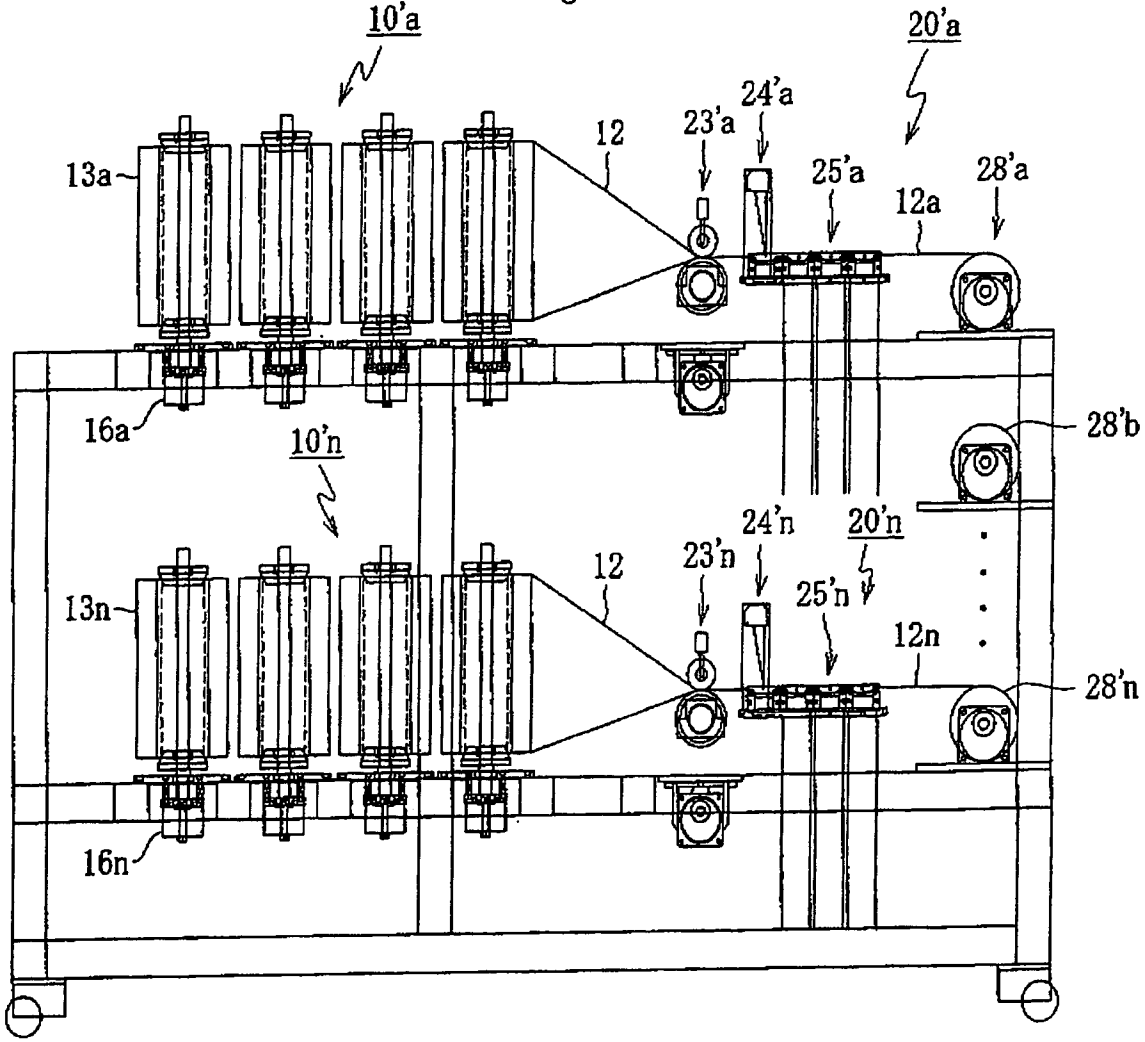
FIG. 14 is a schematic diagram of a carding machine for a double decked form of the multistage multiple spindle bundled fibers according to a seventh embodiment of the present invention.

As shown in FIG. 14, the double decked multistage carding machine for the multiple spindle bundled fibers can be equipped with an upstream feed roll unit 23'*a* and the fiber height detection unit 24'*a* to replace the guide roll 15 or be used in conjunction with the guide roll 15.

Figure 15:
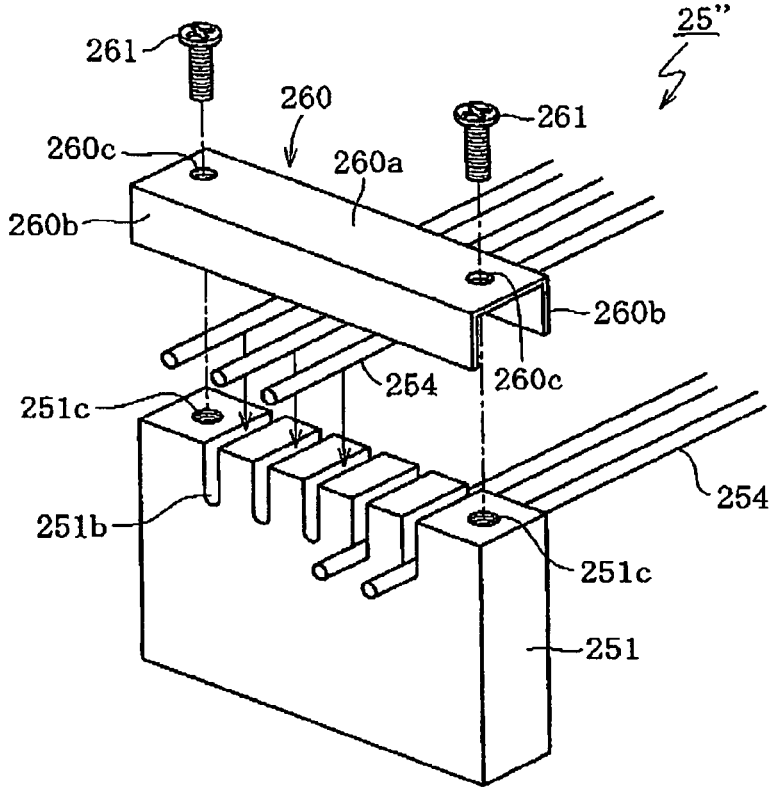
FIG. 15 (A) is an exploded perspective view of a support structure of a supportive part of a carding machine for the multiple spindle bundled fibers according to an eighth embodiment of the present invention.
Figure 15:
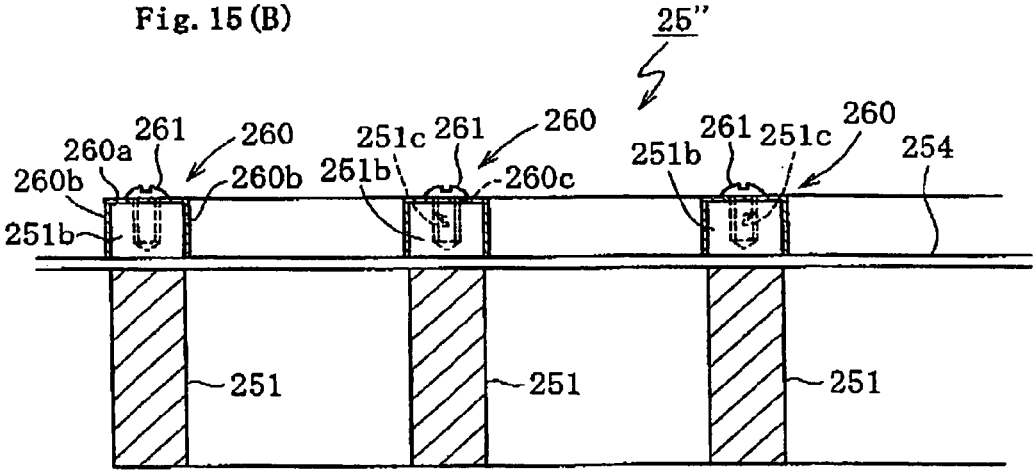

FIGS. 15 (A) and 15 (B) show embodiments of a supportive part in the carding machine for the multiple spindle bundled fibers in accordance with the present invention. As described in FIG. 3, FIG. 4, and FIG. 6, a structure of a plurality of supportive parts 254 and 254' in the airflow carding units 25 and 25' has a drilled hole through the sideboard 251, spacer 255, and guide part 256. Support parts 254 and 254' are inserted into the hole. However, it is complicated to insert many small diameter supporting parts 254 and 254' into many small diameter drilled holes.

Then, in the airflow carding unit 25" in the embodiment shown in FIGS. 15 (A) and 15 (B), the top of the sideboard 251 is cut to form a plurality of slits 251*b* having a certain depth and the supporting part 254 is inserted into the slit 251*b*. In the support structure in which the supporting part 254 is inserted into the slit 251*b*, assembly of the supporting part 254 with the sideboard 251 is much easier and can be completed within a short time of period as compared to insertion of the supportive part 254 into the drilled hole.

In the support structure where the supportive part 254 is inserted into the slit 251*b*, as shown in the figure, a female screw 251*c* is drilled into the top surface of the sideboard 251, which is covered with an approximately U-shaped cap 260 that is tightened with a screw 261. A flat plate 260*a*, a downward vertical plate 260*b* that hangs from both ends, and a drilled hole 260*c* are located such that they match up with the female screw 251*c* of the aforementioned flat plate 260*a*. This arrangement prevents the supportive part 254 from rising in the slit 251*b* and dropping from the slit 251*b*.

The embodiment of FIGS. 15 (A) and 15 (B) shows only the sideboard 251. However, as described previously, as spacer 255 and guiding part 256 are used together with the sideboard 251, a slit can be cut at the same pitch and depth into spacer 255 and guiding part 256 as in sideboard 251, so that the supporting part 254 can be inserted into the slit. If required, sideboard 251, spacer 255 and guiding part 256 are covered with the similar cap 260 and then tightened with the screw.

In the above embodiment, it was described that the sideboard 251 is cut to form a deep slit 251*b*, and the supporting part 254 is supported at a lower position than the top of the sideboard 251. The sideboard 251 can be cut to form a shallow slit and the upper part of the supporting part 254 is supported at the same height as the top of sideboard 251. In this case, the cap 260 can be a flat plate.

In the above embodiment, it was described that the supporting part 254 is placed horizontally in a plane, similar to those in FIG. 4 and FIG. 6. However, similar to the case in FIG. 8, the cut of each slit can be in a crescent form so that the supporting part 254 can be inserted in a crescent form.

Figure 16:
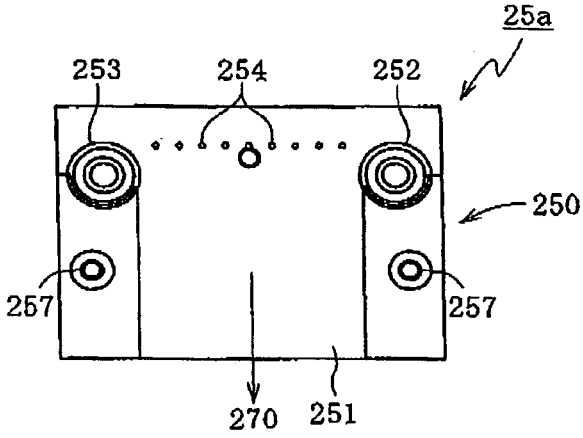
FIG. 16 (A) is a schematic diagram of the airflow carding unit having heated gas.
Figure 16:
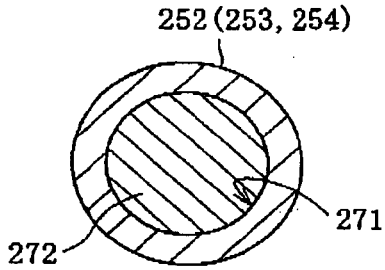
Figure 16:
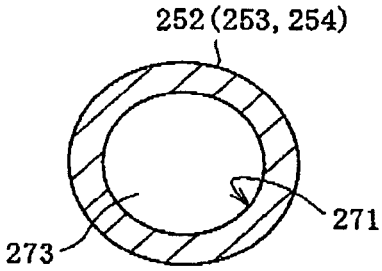
Figure 16:
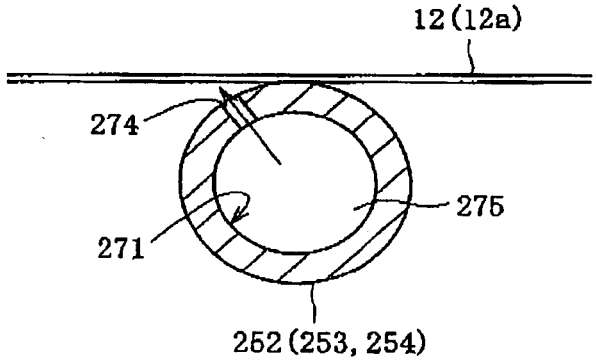

In the above embodiment, a temperature of the air stream flowing into the airflow carding unit 25 through the wind tunnel is not specifically described. However, depending on the kind of adhesive (sizing agent) sticking to each reinforcement filament in the airflow carding machine having a single or multistage airflow carding unit as shown in FIG. 16 (A), a hot air suction wind tunnel can be created in the airflow carding unit where hot air 270 can weaken the adhesion force of the adhesive (sizing agent) and promote the carding action.

In the above embodiment, it has been described that the guiding part and supportive part are solid. However, as shown in FIG. 16(B), the guiding parts 252 and 253 and/or the supportive part 254 can be a pipe and the pipe-shaped guiding parts 252 and 253 and/or supportive part 254 can be equipped with a built-in cartridge heater 272 in a hollow pipe 271 to heat the guiding parts 252 and 253 and/or the supportive part 254. In this setup, the bundled fibers and/or carded sheet is properly heated by the guiding parts 252 and 253 and supportive part 254 that is heated by the cartridge heater 272 to heat and soften the sizing agent in the bundled fibers, reducing the bonding force to generate a smoother carding action.

As shown in FIG. 16C, the guiding parts 252 and 253 and/or the supportive part 254 is pipe-shaped and has a hollow interior 271 can be run with heated fluid 273, such as hot air, steam or hot water can be run. In this setup, the guiding parts 252 and 253 and/or the supportive part 254 is heated by the heated fluid 273 that flows in the pipe and properly heats the bundled fibers and/or carded sheet to heat and soften the sizing agent in the bundled fibers and weaken the bonding force to generate a smoother carding action.

In the carding machine for the multiple spindle bundled fibers, as shown in FIG. 16(D), the guiding parts 252 and 253 and/or supportive part 254 in the final stage of the airflow carding unit have a pipe shape and a slit 274 is defined in the part of the pipe-shaped guiding parts 252 and 253 and/or the supportive part 254 where the slit 274 crosses in the moving direction of the carded sheet. Then, the heated air 275 is run inside of the hollow pipe 271 of the guiding parts 252 and 253 and/or the supportive part 254, ejecting the hot air through slit 274 towards the carded sheet 12*a*. Due to a cooling sizing agent, this leads to the carding of the reinforced filament forming the carded sheet 12*a* in a uniform interval.

More than one of the exemplary embodiments of the present invention are described above, but the present invention is not limited by these examples. The present invention is intended to include the embodiment comprising the description within the spirit and appended claims of the present invention. For example, while it is described in each embodiment that thickness t, in spacer 255 and guiding part 256*a* can be varied stepwise, it can also be continuously varied along the moving direction of the bundled fibers 12 or carded sheet 12*a* to continuously increase the width w, of the traveling path for the bundled fibers 12 or carded sheet 12*a* in a downstream direction.

Or depending on the kind of bundled fibers 12, the distance between the sideboards 251 and 251' of the frames 250 and 250' can continuously fan out towards the moving direction of the bundled fibers 12 or carded sheet 12*a* to continuously increase the width of the traveling path w, for the bundled fibers 12 or carded sheet 12*a*.

Furthermore, it is described in the embodiment shown in FIG. 4 that more than one supporting part 254 is placed horizontally in a plane in each airflow carding units 25*a*, 25*b*, and 25*c*. It is also described in the embodiment of FIG. 6 and FIG. 7 that more than one supportive part 254*a* and 254' is placed horizontally in a plane in the multistage sequential airflow carding units 25' and 25'*a*. However, the supporting parts can be placed in a plane and either tilted upwards or downwards along the moving direction of the bundled fibers 12 in a single or multistage airflow carding unit.

In the above embodiment, an airflow wind tunnel using suction airflow was described, but airflow that is blown can also be used.

Furthermore, in the above embodiment it is described that the guiding parts 252, 253, 252', and 253', the space filling common guiding parts 259*a* and 259*b*, and the supporting parts 254, 254*a*, and 254', are all cylindrical, namely having a constant diameter regardless of the length of the direction. However, the parts can have a large diameter at both ends in the length direction and a smaller diameter that gradually decreases towards the middle, creating a hand drum shape of the guiding and supporting parts. Use of these guiding and supportive parts can reduce the difference in the distance between the center axis line of the single fiber of the bundled fibers 12 and the reinforced filament at both ends of the carded sheet 12*a* to apply a large tension force to the reinforced filament at both ends in the carded sheet 12*a*, as compared to using the cylindrical guiding and supportive parts.

In the above embodiment, it was described that multiple supportive parts are used in all cases. However, at least one or more supportive parts are acceptable and a single supportive part can be used. In this case, the carding effect in the bundled fibers 12 and carded sheet 12*a* is lowered and stabilization of its configuration tends to be more difficult, as compared to the case when more than one supporting part is used. However, as compared to the case in the airflow carding unit without a single supportive part, the carding action occurs before and after the supporting part to lead not only to substantially smoother carding action, but also to stabilize the configuration of the bundled fibers and/or carded sheet because the bundled fibers and/or carded sheet is supported by the supporting part. Both the tension applying means and the tension applied by the rewind roll to bundled fibers 12 and carded sheet 12*a* can further stabilize the bundled fibers 12 and the carded sheet 12*a* even if the support is performed by a single supporting part.

Furthermore, it was described in the above embodiment that the tension applying means 16 is placed on each feed roll 13. However, each feed roll 13 can rotate in reverse and instantly apply tension to the bundled fibers 12. For example, it is possible that a pulley be installed on the shaft of each feed roll 13 and placed with a belt working as a driving force that delivers means for a single driver motor to revolve the roll under low tension in the opposite direction of the bundled fibers 12, resulting in application of an overall constant desired tension to multiple bundled fibers 12. A fact that tension is always applied to the bundled fibers 12 prevents the bundled fibers 12 from loosening and keeps them stretched, when the carding process is temporarily stopped. When the carding process is restarted, the initial setup for the bundled fibers can almost be omitted. Application of a required tension to many bundled fibers 12, on the whole, can possibly keep costs down.

The airflow carding machine for the bundled fibers in the present invention is comprised of a feed roll wound with the bundled fibers; the airflow carding unit to card the bundled fibers drawn out from this feed roll with the airflow orthogonal relative to the moving direction of the bundled fibers; and the rewind roll to rewind the carded sheet that is carded in the airflow carding unit. Since the said airflow carding unit is characterized by having more than one supportive part that is placed at a certain interval along the moving direction of a single or multiple bundled fibers, the carding action of the bundled fibers and carded sheet that travels over a single supportive part or multiple supportive parts in a short distance is applied. This is either applied, at a minimum, twice before and after the supporting part as the carding action of the conventional wind tunnel tube, or stepwise and continuously to make the carding reliable and of better quality.

Furthermore, since the configuration of the bundled fibers or carded sheet is always kept constant along the supporting part of the airflow carding unit, it becomes unnecessary to have a front feeder upstream of the airflow carding unit, or a fiber height detection unit in the airflow carding unit to feedback the fiber height detected to the driver motor for the drive roll of the front feeder to adjust for the overfed condition. Therefore, not only are the number of various component parts, such as the fiber height detection unit, the front feeder, and its driver motor reduced to save parts cost, but also the installation space for these components becomes unnecessary, simplifying the composition to achieve miniaturization, weight reduction and lower cost.

The above effect becomes more pronounced with the increase in the number of stages, as multiple airflow carding units are placed in multistage along the moving direction of the bundled fibers. Furthermore, when the width of the traveling path of the carded sheet in more than one airflow carding unit is increased stepwise or continuously downstream in the moving direction of the carded sheet, an orderly response to the increase in width of the bundled fibers and carded sheet, along with carding of the bundled fibers and carded sheet in the airflow carding unit, achieves smooth continuous carding.

In the present invention, as the shaft of the feed roll of the bundled fibers is placed in the vertical direction, even if the feeding position of the bundled fibers that are drawn out from the feed roll is altered vertically, there is little variation in the supply position in relation to the airflow carding action unit so that the feed roll is not required to traverse towards its shaft direction as in a conventional airflow carding machine where the shaft of the feed roll is placed in a horizontal direction. This can reduce the required installation space for the feed roll and achieve feeding of more than one bundled fibers in the airflow carding machine for the multiple bundled fibers, which was previously difficult to achieve.

In the above embodiment, a simple airflow carding machine was described in all cases. However, the carding machine in the present invention can be used when the carding machine is based on fluids, such as water or oil.

The carding machine for the bundled fibers in the present invention can easily and reliably card the bundled fibers collected from many reinforcing filaments to manufacture a carded sheet.

The invention claimed is:

1. A carding machine for bundled fibers comprises:

a feed roll wound with the bundled fibers;

a carding unit to card the bundled fibers drawn out from the feed roll with a fluid that flows in a direction that is orthogonal relative to a moving direction of the bundled fibers; and a rewind roll that rewinds a carded sheet formed by the bundled fibers that are carded in the carding unit, wherein the carding unit includes:

an internal frame that forms a fluid flow path and a plurality of supporting parts placed along the moving direction of the bundled fibers between a front end and a back end in the moving direction of the bundled fibers within the frame.

2. The carding machine according to claim 1, wherein the carding unit further comprises:

an internal frame that forms a fluid flow path, large diameter guiding parts placed at the front and back ends of the bundled fibers in the moving direction within the frame, and more than one small diameter supporting parts placed between the large diameter guiding parts.

3. The carding machine according to claim 2, wherein a guiding part and/or the at least one supporting part in the carding unit is substantially cylindrical in shaped and is either fixed or is rotatable around a shaft.

4. The carding machine according to claim 3, wherein more than one of the supporting parts are placed in a plane or an approximately crescent form relative to the fluid flow path.

5. The carding machine according to claim 3, wherein a plurality of carding units are placed in a serial arrangement to form multiple stages along the moving direction of the bundled fibers.

6. The carding machine according to claim 4, wherein the carding unit is placed in multiple stages along the moving direction of the bundled fibers within the frame.

7. The carding machine according to claim 5, wherein a width of a traveling path of the bundled fibers in the moving direction increases from an upstream end to a downstream end.

8. The carding machine according to claim 6, wherein a width of a traveling path of the bundled fibers in the moving direction increases from an upstream end to a downstream end.

9. The carding machine according to claim 1, wherein a shaft of the feed roll is arranged vertically relative to the moving direction of the bundled fibers.

10. The carding machine according to claim 2, wherein a shaft of the feed roll is arranged vertically relative to the moving direction of the bundled fibers.

11. The carding machine according to claim 3, wherein a shaft of the feed roll is arranged vertically relative to the moving direction of the bundled fibers.

12. The carding machine according to claim 4, wherein a shaft of the feed roll is arranged vertically relative to the moving direction of the bundled fibers.

13. The carding machine according to claim 5, wherein a shaft of the feed roll is arranged vertically relative to the moving direction of the bundled fibers.

14. The carding machine according to claim 6, wherein a shaft of the feed roll is arranged vertically relative to the moving direction of the bundled fibers.

15. The carding machine according to claim 9, comprising a plurality of feed rolls.

16. The carding machine according to claim 10, comprising a plurality of feed rolls.

17. The carding machine according to claim 11, comprising a plurality of feed rolls.

18. The carding machine according to claim 12, comprising a plurality of feed rolls.

19. The carding machine according to claim 13, comprising a plurality of feed rolls.

20. The carding machine according to claim 14, comprising a plurality of feed rolls.

21. The carding machine according to claim 5, comprising a plurality of carding units arranged in parallel in the direction that is orthogonal relative to the moving direction of the bundled fibers.

22. The carding machine according to claim 6, comprising a plurality of carding units arranged in parallel in the direction that is orthogonal relative to the moving direction of the bundled fibers.

23. The carding machine according to claim 5, wherein the carding unit is placed in more than one stage along the moving direction of the bundled fibers, and/or more than one carding unit is placed in parallel and orthogonal relative to the moving direction of the bundled fibers to form a sequentially integrated form.

24. The carding machine according to claim 6, wherein the carding unit is placed in more than one stage along the moving direction of the bundled fibers, and/or more than one carding unit is placed in parallel and orthogonal relative to the moving direction of the bundled fibers to form a sequentially integrated form.

25. The carding machine according to claim 7, wherein the carding unit is placed in more than one stage along the moving direction of the bundled fibers, and/or more than one carding unit is placed in parallel and orthogonal relative to the moving direction of the bundled fibers to form a sequentially integrated form.

26. The carding machine according to claim 8, wherein the carding unit is placed in more than one stage along the moving direction of the bundled fibers, and/or more than one carding unit is placed in parallel and orthogonal relative to the moving direction of the bundled fibers to form a sequentially integrated form.

27. The carding machine according to claim 21, wherein the carding unit is placed in more than one stage along the moving direction of the bundled fibers, and/or more than one carding unit is placed in parallel and orthogonal relative to the moving direction of the bundled fibers to form a sequentially integrated form.

28. The carding machine according to claim 22, wherein the carding unit is placed in more than one stage along the moving direction of the bundled fibers, and/or more than one carding unit is placed in parallel and orthogonal relative to the moving direction of the bundled fibers to form a sequentially integrated form.

29. The carding machine according to claim 1, wherein the fluid flowing in the carding unit is a heated fluid.

30. The carding machine according to claim 2, wherein the guiding parts and/or supportive part in the carding unit is heated.

31. The carding machine according to claim 30, wherein the guiding parts and/or supportive part is equipped with a built-in heater.

32. The carding machine according to claim 30, wherein the guiding parts and/or supportive part has a cylindrical shape through which heated fluid is flown.

33. The carding machine according to claim 32, wherein the guiding parts and/or supportive part further comprises a slit defined therein, the slit extending in a direction that intersects with the moving direction of the bundled fibers wherein a heated fluid is ejected from the slit.

* * * * *

UNITED STATES PATENT AND TRADEMARK OFFICE

CERTIFICATE OF CORRECTION

PATENT NO. : 7,596,834 B2
APPLICATION NO. : 10/523978
DATED : October 6, 2009
INVENTOR(S) : Hiroaki Shinkado It is certified that error appears in the above-identified patent and that said Letters Patent is hereby corrected as shown below:

On the Title Page

In Item (73) Assignee information, please correct to read as follows:

Item -- (73) Assignee: HARMONI INDUSTRY CO., LTD. --

Signed and Sealed this

Sixteenth Day of February, 2010

David J. Kappos

David J. Kappos
*Director of the United States Patent and Trademark Office*